US011138918B2

(12) United States Patent
Sakariya et al.

(10) Patent No.: US 11,138,918 B2
(45) Date of Patent: Oct. 5, 2021

(54) EMISSION CONTROL APPARATUSES AND METHODS FOR A DISPLAY PANEL

(71) Applicant: Apple Inc., Cupertino, CA (US)

(72) Inventors: Kapil V. Sakariya, Los Altos, CA (US); Tore Nauta, Santa Cruz, CA (US); Hopil Bae, Sunnyvale, CA (US); Henry C. Jen, Los Altos, CA (US)

( * ) Notice: Subject to any disclaimer, the term of this patent is extended or adjusted under 35 U.S.C. 154(b) by 0 days.

(21) Appl. No.: 17/088,903

(22) Filed: Nov. 4, 2020

(65) Prior Publication Data

US 2021/0118353 A1 Apr. 22, 2021

Related U.S. Application Data

(63) Continuation of application No. 15/576,233, filed as application No. PCT/US2016/034876 on May 27, 2016, now Pat. No. 10,847,077.

(Continued)

(51) Int. Cl.
*G09G 3/32* (2016.01)
*G09G 3/20* (2006.01)

(52) U.S. Cl.
CPC ..... *G09G 3/2022* (2013.01); *G09G 3/2014* (2013.01); *G09G 3/2018* (2013.01);

(Continued)

(58) Field of Classification Search
CPC .. G09G 3/2022; G09G 3/2014; G09G 3/2081; G09G 3/2018; G09G 3/32;

(Continued)

(56) References Cited

U.S. PATENT DOCUMENTS 5,783,909 A * 7/1998 Hochstein ..... H05B 45/10 315/159
8,054,266 B2 11/2011 Woo et al.

(Continued)

FOREIGN PATENT DOCUMENTS

EP 0 838 800 A1 4/1998
JP S60-73580 A 4/1985

(Continued)

OTHER PUBLICATIONS

PCT International Search Report and Written Opinion for International Application No. PCT/US2016/034876, dated Aug. 25, 2016,15 pages.

*Primary Examiner* — Carolyn R Edwards
(74) *Attorney, Agent, or Firm* — Aikin & Gallant, LLP

(57) ABSTRACT

Methods and apparatuses relating to controlling an emission of a display panel. In one embodiment, a display driver hardware circuit includes row selection logic to select a number of rows in an emission group of a display panel, wherein the number of rows is adjustable from a single row to a full panel of the display panel, column selection logic to select a number of columns in the emission group of the display panel, wherein the number of columns is adjustable from a single column to the full panel of the display panel, and emission logic to select a number of pulses per data frame to be displayed, wherein the number of pulses per data frame is adjustable from one to a plurality and a pulse length is adjustable from a continuous duty cycle to a non-continuous duty cycle.

17 Claims, 32 Drawing Sheets

Related U.S. Application Data

(60) Provisional application No. 62/171,928, filed on Jun. 5, 2015.

(52) U.S. Cl.
CPC ..... *G09G 3/2081* (2013.01); *G09G 3/32* (2013.01); *G09G 2300/0804* (2013.01); *G09G 2300/0857* (2013.01); *G09G 2300/0861* (2013.01); *G09G 2310/027* (2013.01); *G09G 2310/0272* (2013.01); *G09G 2310/0291* (2013.01); *G09G 2310/08* (2013.01); *G09G 2320/0276* (2013.01); *G09G 2320/0295* (2013.01)

(58) Field of Classification Search
CPC ..... G09G 2300/0861; G09G 2310/08; G09G 2320/0295; G09G 2300/0857; G09G 2310/0272; G09G 2310/0291; G09G 2310/027; G09G 2320/0276; G09G 2300/0804
See application file for complete search history.

(56) References Cited

U.S. PATENT DOCUMENTS

| | | | | |
|---|---|---|---|---|
| 8,786,216 | B2 | 7/2014 | Williams et al. | |
| 9,899,246 | B2 * | 2/2018 | Lin | H01L 21/67393 |
| 10,847,077 | B2 | 11/2020 | Sakariya et al. | |
| 2002/0000982 | A1 | 1/2002 | Takagi | |
| 2002/0059302 | A1 | 5/2002 | Ebihara | |
| 2004/0174388 | A1 | 9/2004 | Sempel et al. | |
| 2005/0116656 | A1 | 6/2005 | Shin | |
| 2005/0134614 | A1 | 6/2005 | Tomohara | |
| 2006/0077193 | A1 | 4/2006 | Thielemans et al. | |
| 2006/0822525 | | 4/2006 | Suzuki et al. | |
| 2006/0170623 | A1 * | 8/2006 | Naugler, Jr. | G09G 3/2081 345/76 |
| 2006/0256045 | A1 | 11/2006 | Jeon et al. | |
| 2007/0211011 | A1 | 9/2007 | Lee | |
| 2007/0279343 | A1 | 12/2007 | Kim | |
| 2009/0140960 | A1 * | 6/2009 | Mahowald | G08B 5/36 345/83 |
| 2010/0207852 | A1 | 8/2010 | Cok | |
| 2010/0265224 | A1 | 10/2010 | Cok | |
| 2011/0043499 | A1 | 2/2011 | Cok et al. | |
| 2011/0074799 | A1 | 3/2011 | Wu et al. | |
| 2014/0168037 | A1 | 6/2014 | Sakariya et al. | |
| 2014/0319486 | A1 | 10/2014 | Hong | |
| 2015/0103103 | A1 | 4/2015 | Kim et al. | |
| 2015/0154933 | A1 | 6/2015 | Bae et al. | |
| 2016/0133185 | A1 * | 5/2016 | Yoon | G09G 3/3233 345/76 |
| 2016/0141352 | A1 * | 5/2016 | Sung | G11C 19/287 257/40 |

FOREIGN PATENT DOCUMENTS

| | | | |
|---|---|---|---|
| JP | 07-319427 | A | 12/1995 |
| JP | 08-137413 | A | 5/1996 |
| JP | 2003-022052 | A | 1/2003 |
| JP | 2003-316312 | A | 11/2003 |
| JP | 2004-361794 | A | 12/2004 |
| JP | 2004-537762 | | 12/2004 |
| JP | 2012-518199 | A | 8/2012 |
| WO | 199724706 | A3 | 7/1997 |
| WO | 2010093850 | A3 | 8/2010 |
| WO | 2010144322 | A1 | 12/2010 |
| WO | 2013070774 | A1 | 5/2013 |

* cited by examiner

Single Ended Driving

Single Ended Alternating polarity

Complementary Driving

Psuedo Twisted Pair 2300
columns
rows
| | | | | | | | | | | | |
|---|---|---|---|---|---|---|---|---|---|---|---|
| 1 | 9 | 17 | 25 | 1 | 9 | 17 | 25 | 1 | 9 | 17 | 25 |
| 2 | 10 | 18 | 26 | 2 | 10 | 18 | 26 | 2 | 10 | 18 | 26 |
| 3 | 11 | 19 | 27 | 3 | 11 | 19 | 27 | 3 | 11 | 19 | 27 |
| 4 | 12 | 20 | 28 | 4 | 12 | 20 | 28 | 4 | 12 | 20 | 28 |
| 5 | 13 | 21 | 29 | 5 | 13 | 21 | 29 | 5 | 13 | 21 | 29 |
| 6 | 14 | 22 | 30 | 6 | 14 | 22 | 30 | 6 | 14 | 22 | 30 |
| 7 | 15 | 23 | 31 | 7 | 15 | 23 | 31 | 7 | 15 | 23 | 31 |
| 8 | 16 | 24 | 32 | 8 | 16 | 24 | 32 | 8 | 16 | 24 | 32 |
| 9 | 17 | 25 | 33 | 9 | 17 | 25 | 33 | 9 | 17 | 25 | 33 |
| 10 | 18 | 26 | 34 | 10 | 18 | 26 | 34 | 10 | 18 | 26 | 34 |
| 11 | 19 | 27 | 35 | 11 | 19 | 27 | 35 | 11 | 19 | 27 | 35 |
| 12 | 20 | 28 | 36 | 12 | 20 | 28 | 36 | 12 | 20 | 28 | 36 |
| 13 | 21 | 29 | 37 | | | | | | | | 7 |
| 14 | 22 | 30 | 38 | | | | | | | | 8 |
| 15 | 23 | 31 | 39 | | | | | | | | 9 |
| 16 | 24 | 32 | 40 | 16 | 24 | 32 | 40 | 16 | 24 | 32 | 40 |
number indicates time when emission pulse starts (au)
fill method: pixels within one row start at different times
FIG. 23A
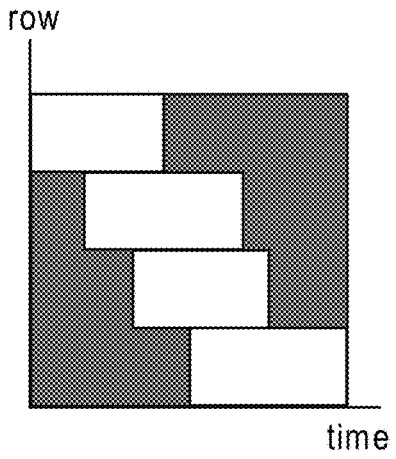
FIG. 23C
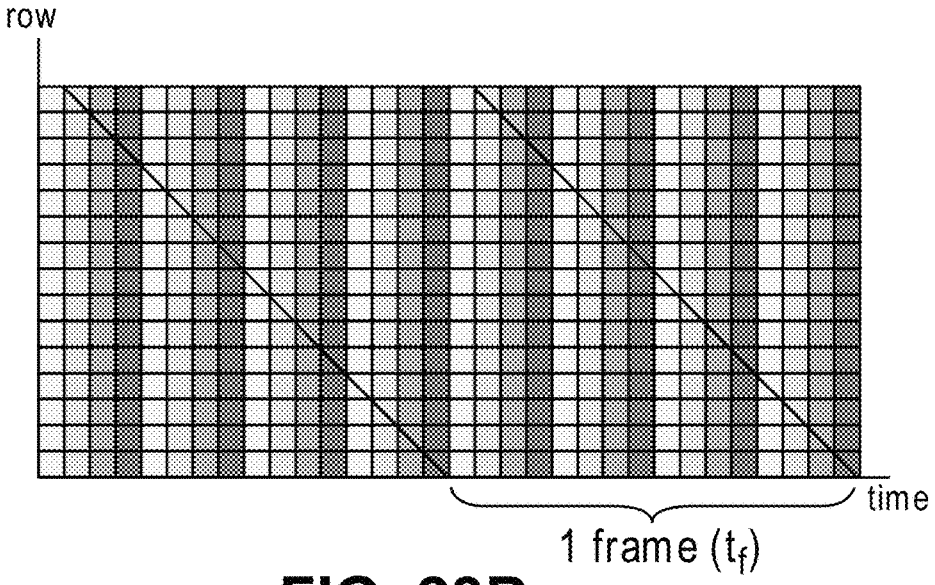
FIG. 23B

2200

| | absolute pulse length | | | | |
|---|---|---|---|---|---|
| GL | pulse 1 | pulse 2 | pulse 3 | pulse 4 | SUM |
| 0 | 0.000 | 0.000 | 0.000 | 0.000 | 0.000 |
| 1 | 0.016 | 0.000 | 0.000 | 0.000 | 0.016 |
| 2 | 0.016 | 0.000 | 0.058 | 0.000 | 0.075 |
| 3 | 0.016 | 0.107 | 0.058 | 0.000 | 0.182 |
| 4 | 0.016 | 0.107 | 0.058 | 0.161 | 0.343 |
| 5 | 0.233 | 0.107 | 0058 | 0.161 | 0.560 |
| 6 | 0.233 | 0.107 | 0.335 | 0.161 | 0.836 |
| 7 | 0.233 | 0.445 | 0.335 | 0.161 | 1.174 |
| 8 | 0.233 | 0.445 | 0.335 | 0.562 | 1.575 |
| 9 | 0.699 | 0.445 | 0.335 | 0.562 | 2.040 |
| 10 | 0.699 | 0.445 | 0.867 | 0.562 | 2.573 |
| 11 | 0.699 | 1.045 | 0.867 | 0.562 | 3.173 |
| 12 | 0.699 | 1.045 | 0.867 | 1.231 | 3.842 |
| 13 | 1.439 | 1.045 | 0.867 | 1.231 | 4.582 |
| 14 | 1.439 | 1.045 | 1.678 | 1.231 | 5.393 |
| 15 | 1.439 | 1.929 | 1.678 | 1.231 | 6.277 |
| 16 | 1.439 | 1.929 | 1.678 | 2.189 | 7.235 |
| 17 | 2.471 | 1.929 | 1.678 | 2.189 | 8.267 |
| 18 | 2.471 | 1.929 | 2.786 | 2.189 | 9.375 |
| 19 | 2.471 | 3.113 | 2.786 | 2.189 | 10.559 |
| 20 | 2.471 | 3.113 | 2.786 | 3.450 | 11.820 |
| 21 | 3.811 | 3.113 | 2.786 | 3.450 | 13.160 |
| 22 | 3.811 | 3.113 | 4.204 | 3.450 | 14.578 |
| 23 | 3.811 | 4.611 | 4.204 | 3.450 | 16.076 |
| 24 | 3.811 | 4.611 | 4.204 | 5.028 | 17.653 |
| 25 | 5.469 | 4.611 | 4.204 | 5.028 | 19.312 |
| 26 | 5.469 | 4.611 | 5.945 | 5.028 | 21.053 |
| 27 | 5.469 | 6.434 | 5.945 | 5.028 | 22.875 |
| 28 | 5.469 | 6.434 | 5.945 | 6.933 | 24.781 |
| 29 | 7.458 | 6.434 | 5.945 | 6.933 | 26.770 |
| 30 | 7.458 | 6.434 | 8.017 | 6.933 | 28.842 |
| 31 | 7.458 | 8.591 | 8.017 | 6.933 | 31.000 |

FIG. 26

EMISSION CONTROL APPARATUSES AND METHODS FOR A DISPLAY PANEL

RELATED APPLICATIONS

This patent application is a continuation of co-pending U.S. application Ser. No. 15/576,233 filed Nov. 21, 2017, which is a U.S. National Phase Application under 35 U.S.C. § 371 of International Application No. PCT/US2016/034876, filed May 27, 2016, entitled EMISSION CONTROL APPARATUSES AND METHODS FOR A DISPLAY PANEL, which claims the benefit of priority of U.S. Provisional Application No. 62/171,928 filed Jun. 5, 2015, both of which are herein incorporated by reference.

BACKGROUND

Field

The disclosure relates generally to a display system, and, more specifically, to emission control apparatuses and methods for a display panel.

Background Information

Display panels are utilized in a wide range of electronic devices. Common types of display panels include active matrix display panels where each pixel may be driven to display a data frame. High-resolution color display panels, such as computer displays, smart phones, and televisions, may use an active matrix display structure. An active matrix display of m×n display (e.g., pixel) elements may be addressed with m row lines and n column lines or a subset thereof. In conventional active matrix display technologies a switching device and storage device is located at every display element of the display. A display element may be a light emitting diode (LED) or other light emitting material. A storage device(s) (e.g., a capacitor or a data register) may be connected to each display (e.g., pixel) element, for example, to load a data signal therein (e.g., corresponding to the emission to be emitted from that display element). The switches in conventional displays are usually implemented through transistors made of deposited thin films, and thus are called thin film transistors (TFTs). A common semiconductor used for TFT integration is amorphous silicon (a-Si), which allows for large-area fabrication in a low temperature process. A main difference between a-Si TFT and a conventional silicon metal-oxide-semiconductor-field-effect-transistor (MOSFET) is lower electron mobility in a-Si due to the presence of electron traps. Another difference includes a larger threshold voltage shift. Low temperature polysilicon (LTPS) represents an alternative material that is used for TFT integration. LTPS TFTs have a higher mobility than a-Si TFTs, yet mobility is still lower than for MOSFETs.

SUMMARY

Methods, systems, and apparatuses for controlling an emission of a display panel are described. In one embodiment, a display driver hardware circuit includes row selection logic to select a number of rows in an emission group of a display panel, in which the number of rows is adjustable from a single row to a full panel of the display panel, column selection logic to select a number of columns in the emission group of the display panel, in which the number of columns is adjustable from a single column to the full panel of the display panel, and emission logic to select a number of pulses per data frame to be displayed, in which the number of pulses per data frame is adjustable from one to a plurality and a pulse length is adjustable from a continuous duty cycle to a non-continuous duty cycle. The display driver hardware circuit may include a plurality of non-linear gray scale clocks, and in which the emission logic is to compare a first data signal to a number of pulses from a first non-linear gray scale clock to cause an emission by a first display element when the first data signal differs from the number of pulses from the first non-linear gray scale clock, and is to compare a second data signal to a second number of pulses from a second non-linear gray scale clock to cause an emission by a second, different colored display element when the second data signal differs from the second number of pulses from the second non-linear gray scale clock. The display driver hardware circuit may include a timing offset circuit to begin emissions of adjacent display elements of the display panel at different times. The number of pulses per data frame to be displayed may be a plurality of pulses and the emission logic may increase a pulse length of less than all of the plurality of pulses for each successive gray level. The emission group may be a pixel comprising at least one red light emitting diode (LED), green LED, and blue LED, though this particular arrangement is exemplary and other LED color arrangements in a pixel may be used.

In an embodiment, a method to drive a display panel includes selecting a number of rows in an emission group of a display panel with row selection logic, with the number of rows being adjustable from a single row to a full panel of the display panel, selecting a number of columns in the emission group of the display panel with column selection logic, with the number of columns being adjustable from a single column to the full panel of the display panel, and selecting a number of pulses per data frame to be displayed with emission logic, with the number of pulses per data frame being adjustable from one to a plurality and a pulse length is adjustable from a continuous duty cycle to a non-continuous duty cycle. The method may include comparing a first data signal to a number of pulses from a first non-linear gray scale clock to cause an emission by a first display element when the first data signal differs from the number of pulses from the first non-linear gray scale clock, and comparing a second data signal to a second number of pulses from a second non-linear gray scale clock to cause an emission by a second, different colored display element when the second data signal differs from the number of pulses from the second non-linear gray scale clock. The method may include beginning emissions of adjacent display elements of the display panel at different times with a timing offset circuit. The number of pulses per data frame to be displayed may be a plurality of pulses and the emission logic may increase a pulse length of less than all of the plurality of pulses for each successive gray level. The emission group may be a pixel comprising at least one red light emitting diode (LED), green LED, and blue LED, though this particular arrangement is exemplary and other LED color arrangement sin a pixel may be used.

In an embodiment, a display driver hardware circuit includes a counter to store a number of pulses of a non-linear gray scale clock, and a plurality of unit circuits. Each unit circuit may include a data register to store a data signal, a comparator to compare the data signal from the data register to the number of pulses to cause an emission by a display element when the data signal differs from the number of pulses, and a timing offset circuit to begin emissions of adjacent display elements at different times. The adjacent display elements may be a row of a display panel. The adjacent display elements may be a column of a display panel. The adjacent display elements may be multiple rows and multiple columns of a display panel. Each display element may be a pixel.

In an embodiment, a method to drive a display panel includes counting a number of pulses of a non-linear gray scale clock, storing a first data signal in a first data register and a second data signal in a second data register, comparing the first data signal from the first data register to the number of pulses to cause an emission by a first display element of the display panel when the first data signal differs from the number of pulses, comparing the second data signal from the second data register to the number of pulses to cause an emission by an adjacent, second display element of the display panel when the second data signal differs from the number of pulses, and beginning the emission by the first display element and the emission of the adjacent, second display element at different times. The method may include providing the first display element and the adjacent, second display element as a row of the display panel. The method may include providing the first display element and the adjacent, second display element as a column of the display panel. The method may include providing the first display element and the adjacent, second display element as multiple rows and multiple columns of the display panel. The method may include providing each of the first display element and the adjacent, second display element as a pixel.

In an embodiment, a display driver hardware circuit includes a data register to store a data signal, a counter to store a number of pulses of a gray scale clock, and a comparator to compare the data signal from the data register to the number of pulses to cause an emission by a display element when the data signal differs from the number of pulses, where the emission is to include multiple pulses for each data frame to be displayed and each successive gray level is to increase a pulse length of less than all of the multiple pulses (gray level may be modulated with an increased pulse length of less than all of the multiple pulses in a data frame). The gray scale clock may be a non-linear gray scale clock. Each successive gray level may increase a pulse length of only one pulse of the multiple pulses. The multiple pulses may be at a same amplitude. The multiple pulses may be at least three pulses.

In an embodiment, a method to drive a display panel includes counting a number of pulses of a gray scale clock, storing a data signal in a data register, and comparing the data signal from the data register to the number of pulses to cause an emission by a display element of the display panel when the data signal differs from the number of pulses, where the emission includes multiple pulses for each data frame to be displayed and each successive gray level is to increase a pulse length of less than all of the multiple pulses (gray level may be modulated by increasing a pulse length of less than all of the multiple pulses in a data frame). The counting may include counting the number of pulses of a non-linear gray scale clock. Each successive gray level may increase a pulse length of only one pulse of the multiple pulses. The multiple pulses may be at a same amplitude. The multiple pulses may be at least three pulses.

In an embodiment, a display driver hardware circuit includes means to select a number of rows in an emission group of a display panel, in which the number of rows is adjustable from a single row to a full panel of the display panel, means to select a number of columns in the emission group of the display panel, in which the number of columns is adjustable from a single column to the full panel of the display panel, and means to select a number of pulses per data frame to be displayed, in which the number of pulses per data frame is adjustable from one to a plurality and a pulse length is adjustable from a continuous duty cycle to a non-continuous duty cycle.

In an embodiment, a display system includes a backplane including an active area, a row of column drivers including a plurality of column drivers, a column of row drivers including a plurality of row drivers, an array of micro driver chips in the active area, an array of micro LEDs in the active area and electrically connected to the array of micro driver chips, an emission controller.

Each micro driver chip may control a plurality of pixels. In an embodiment, the micro driver chips are surface mounted on the backplane in the active area. The plurality of column drivers and the plurality of row drivers may likewise be surface mounted on the backplane. The emission controller may include a non-linear clock generator, which may additionally include a plurality of non-linear clock generators. For example, the plurality of non-linear clock generators may include a first non-linear clock generator to provide a non-linear clock pulse signal for red emitting micro LEDs. Separate non-linear clock generator may be provided for each different color emitting micro LED. In an embodiment, a non-linear clock generator provides a non-linear clock pulse signal to a group of different color emitting LEDs, such as for both blue and green emitting LEDs.

BRIEF DESCRIPTION OF THE DRAWINGS

Embodiments are illustrated by way of example and not limitation in the Figures of the accompanying drawings:

FIG. 23A is schematic timing diagram of an emission pattern according to one embodiment of the disclosure.

FIG. 23B is a time and row position diagram for an emission pattern according to one embodiment of the disclosure.

FIG. 23C is an embodiment of a time and row position diagram for a square of the grid in FIG. 23B.

FIG. 26 is a pulse diagram for emission control according to one embodiment of the disclosure.

DETAILED DESCRIPTION

Figure 1:
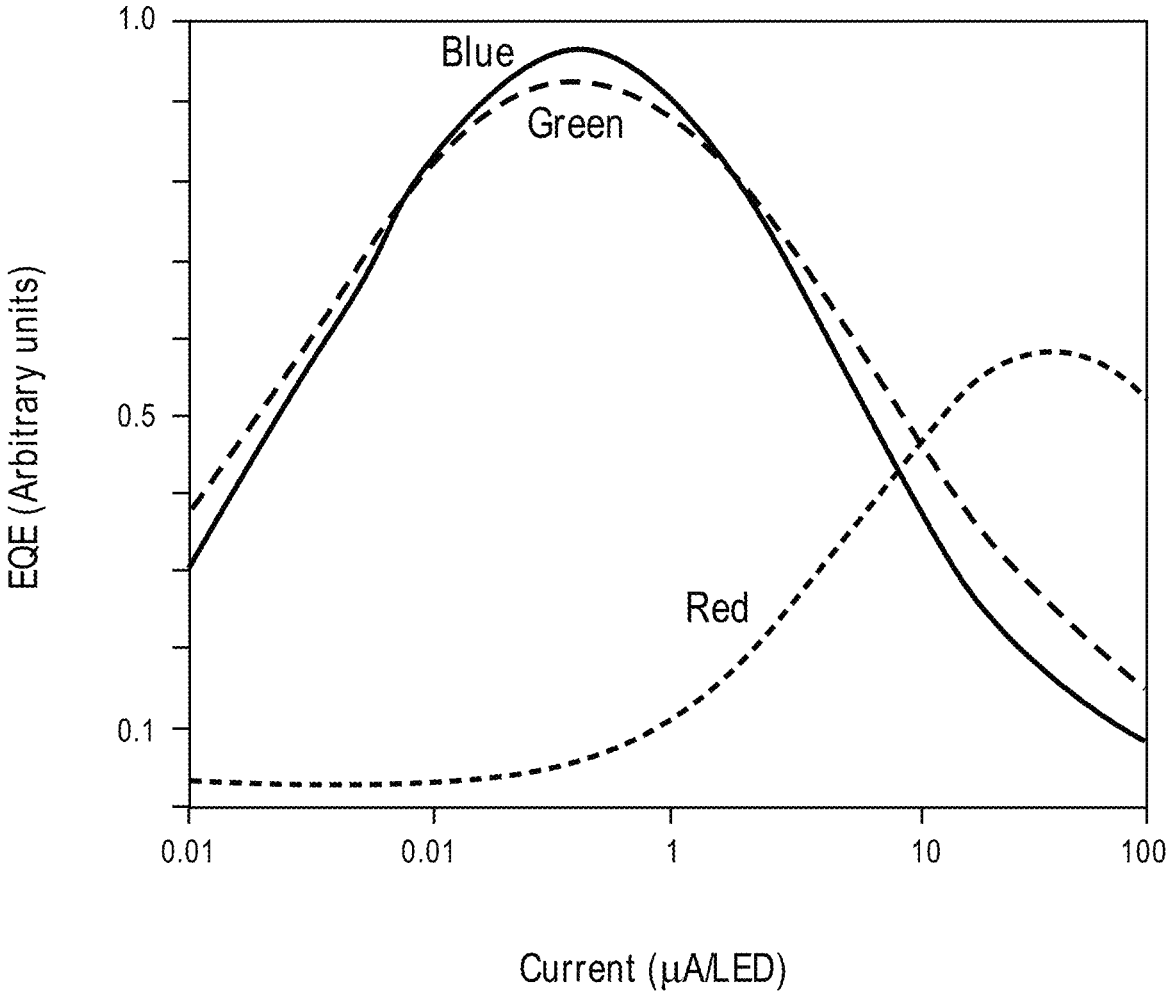
FIG. 1 is a graphical illustration of the relationship of external quantum efficiency (EQE) to operating current for a semiconductor-based micro LED in accordance with an embodiment.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the present disclosure. In other instances, well-known techniques and components have not been described in particular detail in order to not unnecessarily obscure the present disclosure. Reference throughout this specification to "one embodiment," "an embodiment", or the like means that a particular feature, structure, configuration, or characteristic described in connection with the embodiment is included in at least one embodiment of the disclosure. Thus, the appearances of the phrase "in one embodiment," "in an embodiment", or the like in various places throughout this specification are not necessarily referring to the same embodiment of the disclosure. Furthermore, the particular features, structures, configurations, or characteristics may be combined in any suitable manner in one or more embodiments.

In accordance with some embodiments, a display panel is described including an arrangement of microdriver (also referred to as μD or μDriver) chips and micro LEDs (also referred to as μLEDs). Additionally, methods, systems, and apparatuses for controlling an emission of a display panel (e.g., its display elements) are discussed herein. In particular, methods, systems, and apparatuses are described for emission control, including grey scale control, that are particularly applicable to a display panel including an arrangement of microdriver chips and micro LEDs.

In an embodiment, a micro LED may be a semiconductor-based material having a maximum lateral dimension of 1 to 300 μm, 1 to 100 μm, 1 to 20 μm, or more specifically 1 to 10 μm, such as 5 μm. For example, a microdriver chip may have a maximum lateral dimension of 1 to 300 μm, and may fit within the pixel layout of the micro LEDs. In accordance with embodiments, the microdriver chips can replace the switch(s) and storage device(s) for each display element as commonly employed in a TFT architecture. The microdriver chips may include digital unit cells, analog unit cells, or hybrid digital and analog unit cells. Additionally, MOSFET processing techniques may be used for fabrication of the microdriver chips on single crystalline silicon as opposed to TFT processing techniques on a-Si or LTPS. In accordance with other embodiments the microdrivers may represent logic/circuits formed within the display substrate, for example, within a monocrystalline silicon substrate, rather than surface mounted chips.

In one aspect, significant efficiencies may be realized over TFT integration techniques. For example, microdriver chips may utilize less real estate of a display substrate than TFT technology. For example, microdriver chips incorporating a digital unit cell can use a digital storage element (e.g. register) which consumes comparatively less area than an analog storage capacitor. Where the microdriver chips include analog components, MOSFET processing techniques on single crystalline silicon can replace thin film techniques that form larger devices with lower efficiency on a-Si or LTPS. Microdriver chips may additionally require less power than TFTs formed using a-Si or LTPS. In other embodiments, the microdriver logic/circuits may be formed within the display substrate, for example, within a monocrystalline silicon substrate using MOSET processing techniques that may provide efficiencies compared to TFT integration.

In another aspect, a micro LED display element may be utilized, e.g., such that the power consumed by the micro LED is a minor portion of the total power consumption of the display device, for example, from a battery. In such an aspect, micro LEDs may be highly efficient at light emission and consume significantly (e.g., orders of magnitude) less power at emission compared to other display elements such as organic light emitting diodes (OLED) and liquid crystal display (LCD). FIG. 1 is a graphical illustration of the relationship of external quantum efficiency (EQE) to operating current for a semiconductor-based micro LED in accordance with an embodiment. Embodiments are not limited to the exemplary EQE curves and operating currents illustrated in FIG. 1, though the illustration shows some relationships that may be applicable to one or more embodiments. For example, micro LEDs designed for different color emission may have different characteristic efficiencies. In the particular embodiment illustrated, the blue and green emitting micro LEDs have more similar characteristic EQE curves than the red emitting micro LED. Efficiencies may depend upon a variety of factors, including materials selection, fabrication methods, size, shape, etc. Additionally, maximum efficiency ranges occur at different operating currents and current densities for different micro LEDs. In the embodiment illustrated in FIG. 1, blue and green emitting micro LEDs may have a characteristic maximum efficiency range between 0.1 and 20 μA, while red emitting micro LEDs may have a characteristic maximum efficiency range between 10 and 200 μA. Furthermore, the current ranges illustrated in exemplary FIG. 1 may be relatively high compared to OLED or LCD.

In another aspect, embodiments describe a digital display architecture in which short pulses can be supplied from a constant current source, and at specified levels on the EQE curves for the color-specific LEDs. For example, emission pulses widths can be as low as 10 ns without being sensitive to micro LED pulse slew rates (e.g., there will be two edges for all grey levels). The minimum pulse width, e.g. 10 ns, may be much smaller than a line time, e.g. 40 μs. The number of rows in an emission group may be adjustable from a single row to the full panel. The number of pulses per frame may be adjustable from, e.g., 1 to 10. The emission pulse length may be adjustable from continuous (100% duty cycle) to 10 ns. The control column may specify which pixel emits within a row, and the number of column may be adjustable from a single column to the full panel. In some embodiments, multiple emission pulses may be supplied with each data frame. In certain embodiments, grey levels are achieved by pulse width modulation (PWM) of the emission pulse to the display elements. In some embodiments including multiple emission pulses per data frame, one or more pulse widths may be modified to achieve a specified grey level.

Figure 2:
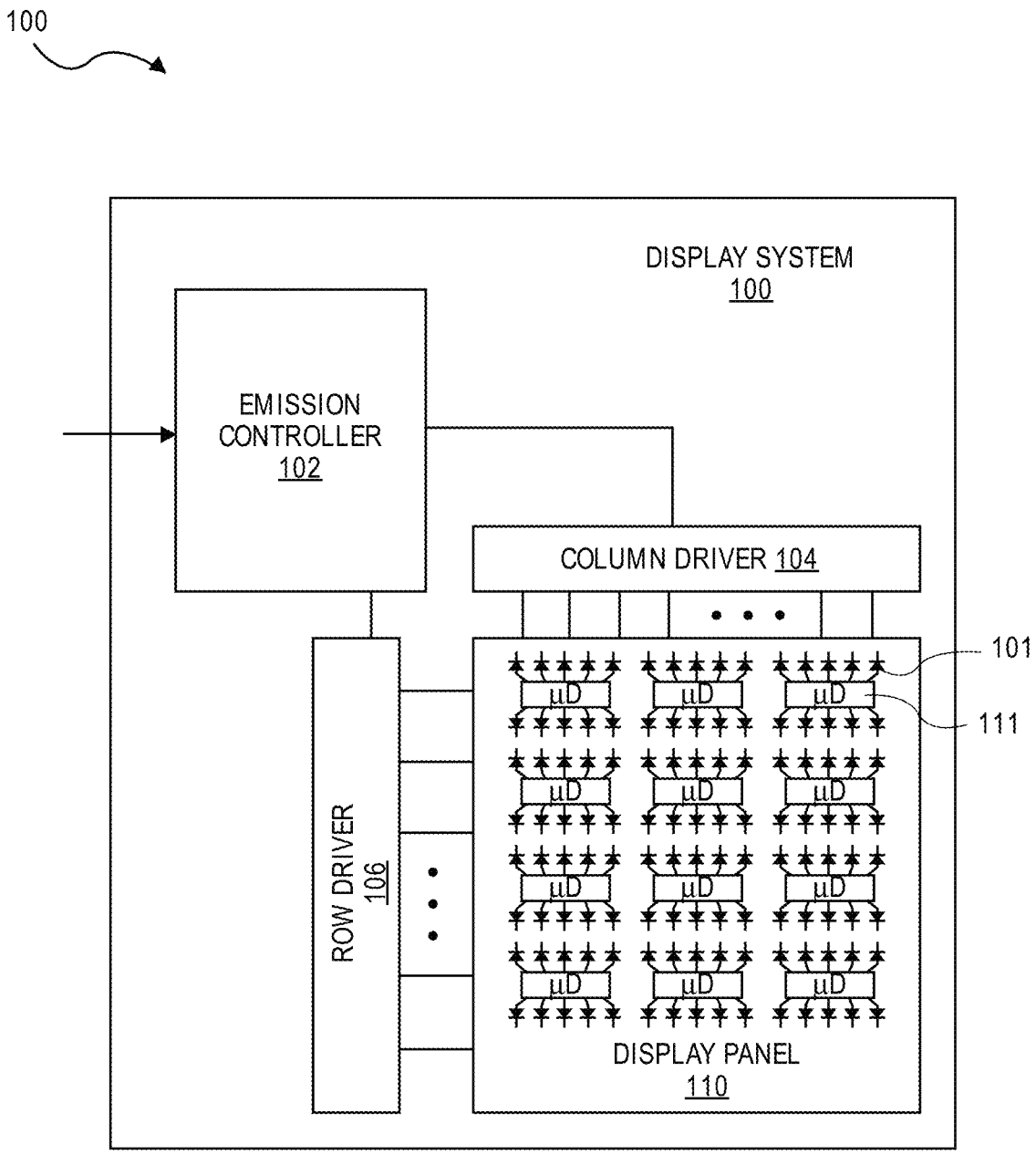
FIG. 2 is a display system according to one embodiment of the disclosure.

FIG. 2 is a display system 100 according to one embodiment of the disclosure. Emission controller 102 may receive as an input the content to be displayed on (e.g., all or part of) a display panel 110, e.g., an input signal corresponding to the picture information (e.g., a data frame). Emission controller may include a circuit (e.g., logic) to selectively cause a display element to emit (e.g., visible to a human eye) light. An emission controller may cause a storage device(s) (e.g., a capacitor or a data register) for (e.g., operating) a display element (e.g., of the plurality of display elements) to receive a data signal (e.g., a signal to turn a display element off or on). A column driver 104 and/or row driver 106 may be a component of the emission controller. A column driver 104 may allow the emission controller 102 to communicate with (e.g., control) a column of display elements. A row driver 106 may allow the emission controller 102 to communicate with (e.g., control) a row of display elements. A column driver 104 and a row driver 106 may allow an emission controller 102 to communicate with (e.g., control) an individual display element or a group of display elements (e.g., a pixel or subpixel).

Display panel 110 may include a matrix of pixels. Each pixel may include multiple subpixels that emit different colors of lights. In a red-green-blue (RGB) subpixel arrangement, each pixel may include three subpixels that emit red light, green light, and blue light, respectively. It is to be appreciated that the RGB arrangement is exemplary and that this disclosure is not so limited. Examples of other subpixel arrangements that can be utilized include, but are not limited to, red-green-blue-yellow (RGBY), red-green-blue-yellow-cyan (RGBYC), or red-green-blue-white (RGBW), or other subpixel matrix schemes where the pixels may have different number of subpixels. In an embodiment, one or more display elements (e.g., LED 101) may connect to a microdriver (e.g., μD 111) that drives (e.g., according to the emission controller 102) the emission of light from the one or more display elements. For example, the microdrivers 111 and display elements 101 may be surface mounted on the display panel 110. Although the depicted microdrivers include ten display elements, the disclosure is not so limited and a microdriver may drive one display element or any plurality of display elements. In an embodiment, display element (e.g., 101) may be a pixel, for example, with each pixel including three display element subpixels (e.g., a red, green, and blue LED).

In one embodiment, a display driver hardware circuit (e.g., a hardware emission controller) may include one or more of: (e.g., row selection) logic to select a number of rows in an emission group of a display panel, in which the number of rows is adjustable from a single row to a full panel of the display panel, (e.g., column selection) logic to select a number of columns in the emission group of the display panel, in which the number of columns is adjustable from a single column to the full panel of the display panel, and (e.g., emission) logic to select a number of pulses per data frame to be displayed, in which the number of pulses per data frame is adjustable from one to a plurality and a pulse length is adjustable from a continuous duty cycle to a non-continuous duty cycle. An emission controller may include hardware, software, firmware, or any combination thereof. In one embodiment, an emission controller causes a display refresh of 60 Hz to 240 Hz with four pulses of a display element (e.g., LED) per video frame.

Figure 3A:
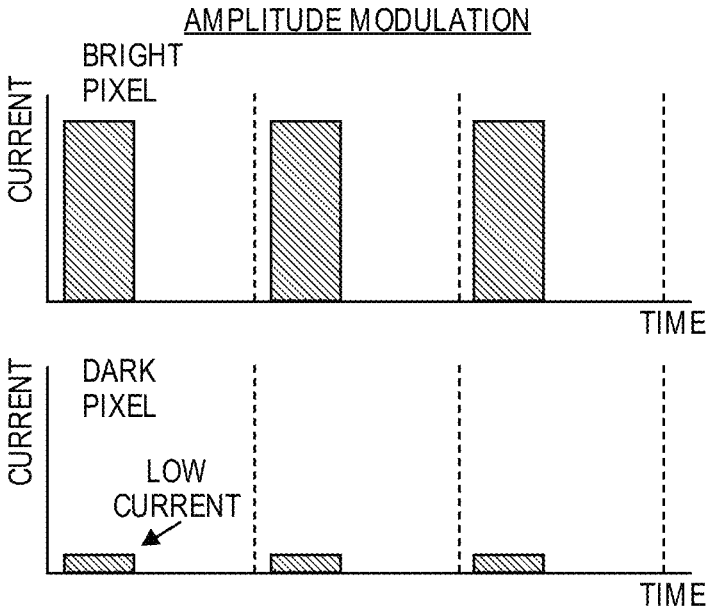
FIG. 3A is an illustration of amplitude modulation (AM) in which the current level per pixel sets the grey level according to one embodiment of the disclosure.
Figure 3B:
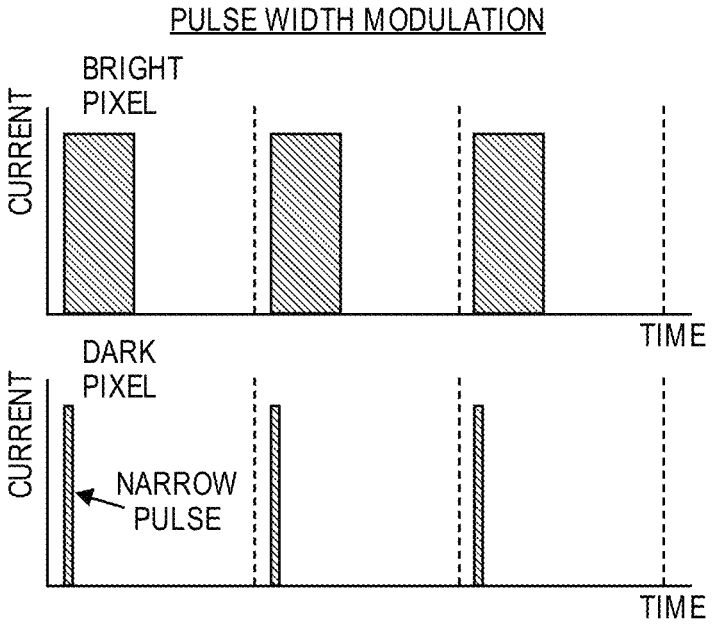
FIG. 3B is an illustration of pulse width modulation (PWM) in which the pulse width sets the grey level according to one embodiment of the disclosure.
Figure 3C:
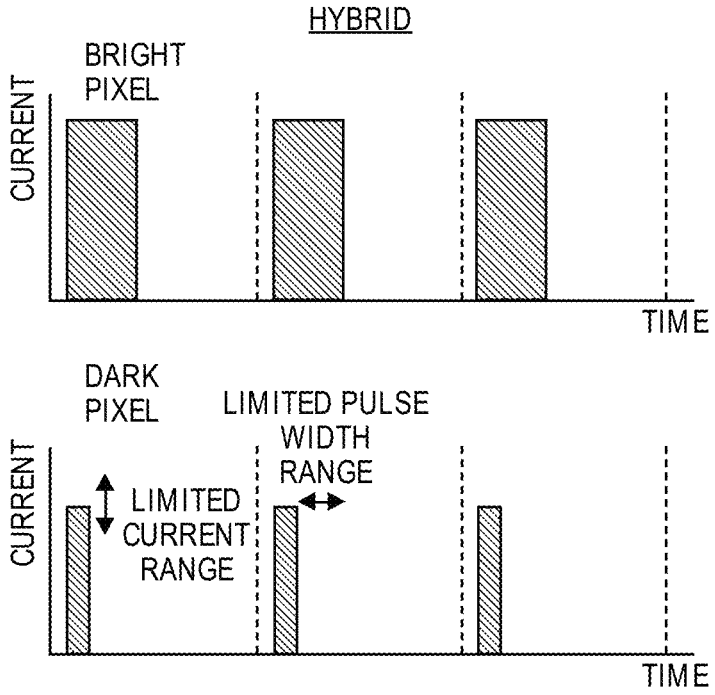
FIG. 3C is an illustration of a hybrid modulation in which pulse width may be modulated to set a coarse grey level, and current level is modulated to set a fine grey level according to one embodiment of the disclosure.

FIGS. 3A-3C are generic illustrations for various manners for controlling emission pulses to a display element for controlling grey scale, or perceived brightness as viewed by the human eye, in accordance with embodiments. FIG. 3A is an illustration of amplitude modulation (AM) in which the current level per pixel sets the grey level, in accordance with an embodiment. As illustrated, a higher current level corresponds to a higher brightness, with lower current level corresponding to a lower brightness, or dark pixel. In an embodiment, global pulse width or length can be set at a constant where amplitude modulation is used to set the grey level. Referring briefly back to FIG. 1, in an embodiment utilizing AM, a variable current range may be selected at a specific current range corresponding to a specified EQE range of the LED.

FIG. 3B is an illustration of pulse width modulation (PWM), also referred to as pulse length modulation, in which the pulse width or length sets the grey level, in accordance with an embodiment. As illustrated, a higher pulse width or length corresponds to a higher brightness, with a narrower pulse corresponding to a lower brightness, or dark pixel. In an embodiment, global current can be set at a constant where PWM is used to set the grey level. Referring briefly back to FIG. 1, in an embodiment utilizing PWM, a constant current level may be selected at a specific current corresponding to a specified EQE of the LED.

In accordance with embodiments utilizing AM, LEDs are driven in a range of current levels. Where LED performance drift occurs during the lifetime of the LED, the LEDs may potentially behave differently at low current levels later in life, or the EQE may not be optimal (e.g., lower on the EQE curve) at the lower current levels. In accordance with embodiments utilizing PWM, LEDs are driven with a range of pulse widths, which may potentially require very small pulse widths to produce the lowest grey levels. FIG. 3C is an illustration of a hybrid modulation in accordance with an embodiment in which pulse width may be modulated to set a coarse grey level, and current level is modulated to set a fine grey level. As illustrated, a higher current level and pulse width corresponds to a higher brightness, with a lower current level and narrower pulse corresponding to a lower brightness, or dark pixel. In an embodiment, hybrid modulation is employed for high dynamic displays, which can require dynamic ranges up to $10^6$, where deficiencies in relying solely on AM or PWM may be apparent.

Figure 4:
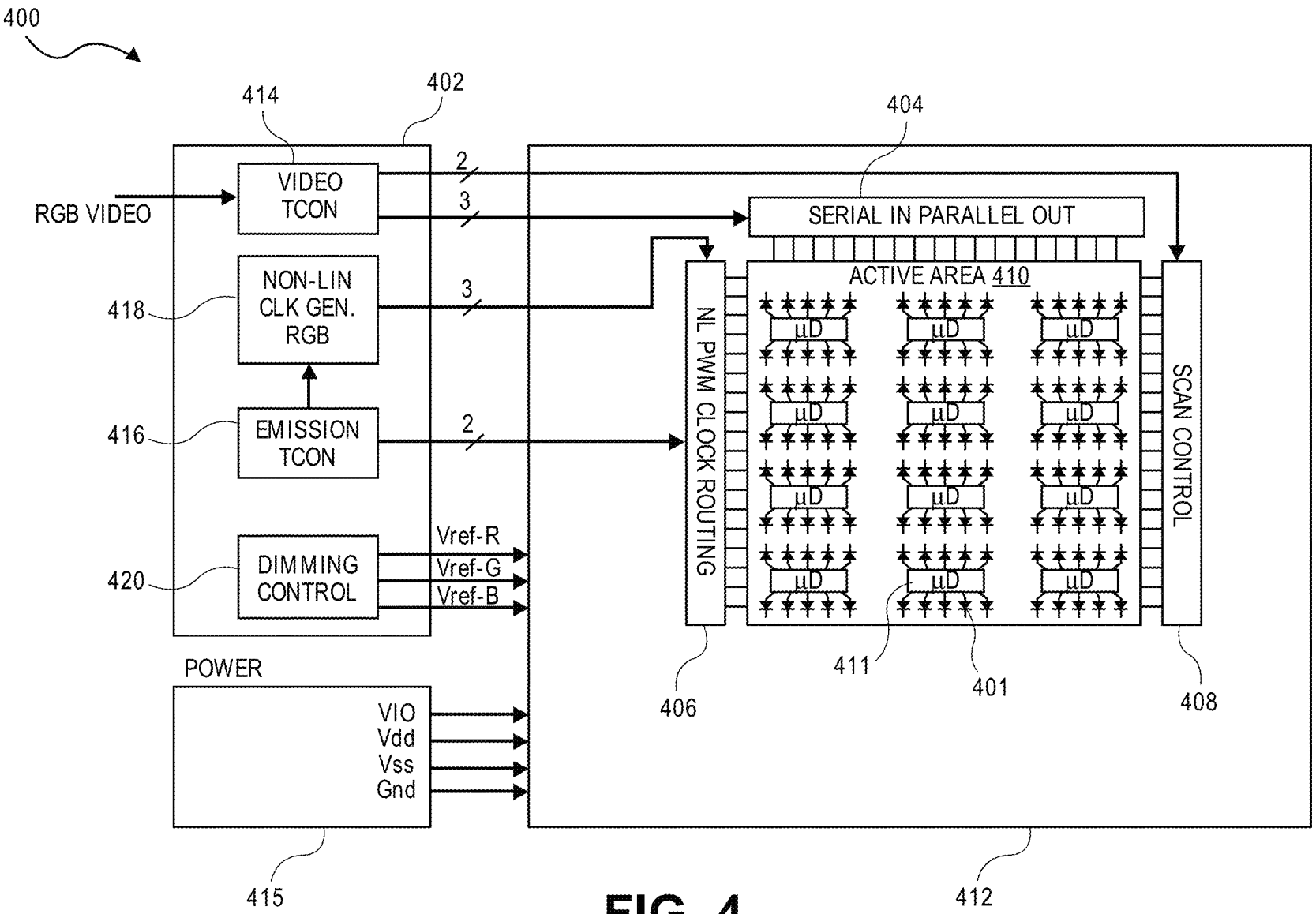
FIG. 4 is a display system with multiple microdrivers (μD) according to one embodiment of the disclosure.

FIG. 4 is a display system 400 according to one embodiment of the disclosure. Emission controller 402 may be a field-programmable gate array (FGPA) integrated circuit. Depicted emission controller 402 includes a video timing controller 414, e.g., to provide timing control signals to the display backplane 412, a (e.g., non-linear) clock generator 418 which may be controlled by an emission timing controller 416, and a dimming controller 420. Power module 415 may power the components of display system 400. Emission controller 402 may receive an input of a data (e.g., signals) that contains the display (e.g., pixel) data and provide the data (e.g., signals) to cause the display elements (e.g., LEDs) of the active area 410 to emit light according to the display data. In an embodiment, the depicted backplane 412 includes a (e.g., non-linear) pulse width modulation (PWM) clock routing circuit 406, e.g., to route the clock signals to the active area 410. Depicted backplane 412 includes a serial in parallel out circuit 404, e.g., to route the video signals to the active area 410. Depicted backplane 412 includes a scan control circuit 408, e.g., to route the display data signals to the active area 410. One or more display elements (e.g., LED 401) may connect to a microdriver (e.g., μD 411) that drives (e.g., according to the emission controller 402) the emission of light from the one or more display elements. Although the depicted microdrivers include ten display elements, the disclosure is not so limited and a microdriver may drive one display element or any plurality of display elements. Display element (e.g., 401) may be a pixel, for example, with each pixel including three display element subpixels (e.g., a red, green, and blue LED).

Figure 5:
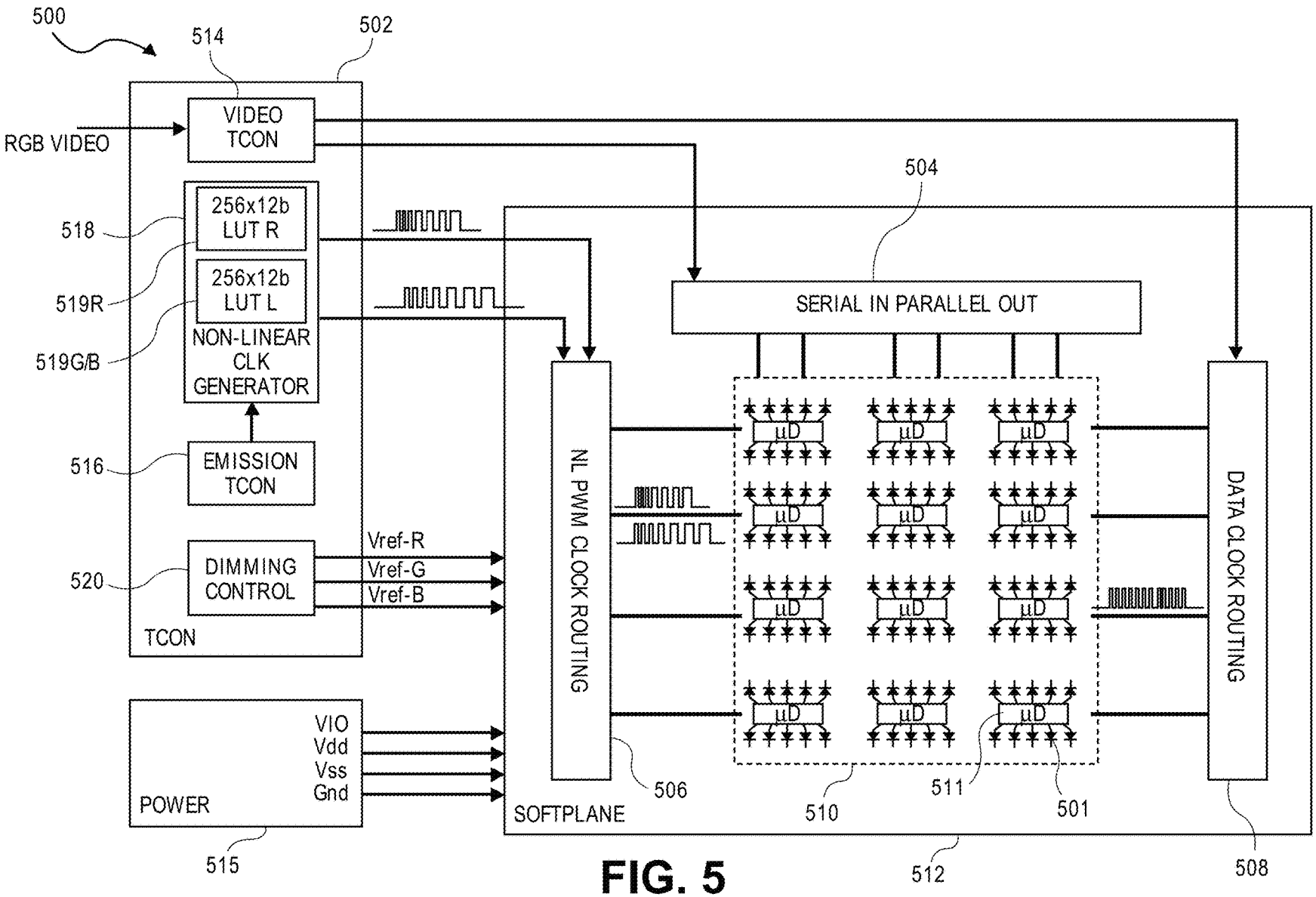
FIG. 5 is a display system with multiple microdrivers (μD) according to one embodiment of the disclosure.

FIG. 5 is a display system 500 with multiple microdrivers (μD) according to one embodiment of the disclosure. Emission controller 502 may be a field-programmable gate array (FGPA) integrated circuit. Depicted emission controller 502 includes a video timing controller 514, e.g., to provide timing control signals to the display backplane 512, non-linear clock generator 518 which may be controlled by an emission timing controller 516, and a dimming controller 520. Depicted non-linear clock generator 518 includes two look-up tables (LUT), e.g., a red (R) light emitting element LUT 519R and a green (G) and blue (B) LUT 519G/B, to provide one non-linear clock signal for the red light emitting elements and another non-linear clock signal for the green and blue light emitting elements. Each pulse from a non-linear clock generator may have the same amplitude (e.g., height) but be of varying widths (e.g., as a function of the amount of the time the pulse is active (goes high)). In one embodiment, each color of light emitting element (e.g., red, green, and blue) may have its own non-linear clock signal. Power module 515 may power the components of display system 500. Emission controller 502 may receive an input of data (e.g., signals) that contains the display (e.g., pixel) data and provide the data (e.g., signals) to cause the display elements (e.g., LEDs) of the active area to emit light according to the display data via the microdrivers in active area 510. Depicted backplane 512 includes a non-linear pulse width modulation (PWM) clock routing circuit 506, e.g., to route the clock signals to the active area 510. Depicted backplane 512 includes a serial in parallel out circuit 504, e.g., to route the video signals to the active (e.g., display) area 510. Depicted backplane 512 includes a data clock routing (e.g., scan control) circuit 508, e.g., to route the display data signals to the active area 510. Data clock routing (e.g., scan control) circuit 508 may utilize a linear clock signal, e.g., to gate the display data signals into its circuitry. This clock signal may be provided by the video timing controller 514. One or more display elements (e.g., LED 501) may connect to a microdriver (e.g., μD 511) that drives (e.g., according to the emission controller 502) the emission of light from the one or more display elements. Although the depicted microdrivers include ten display elements, the disclosure is not so limited and a microdriver may drive one display element or any plurality of display elements. Display element (e.g., 501) may be a pixel, for example, with each pixel including three display element subpixels (e.g., a red, green, and blue LED).

Figure 6:
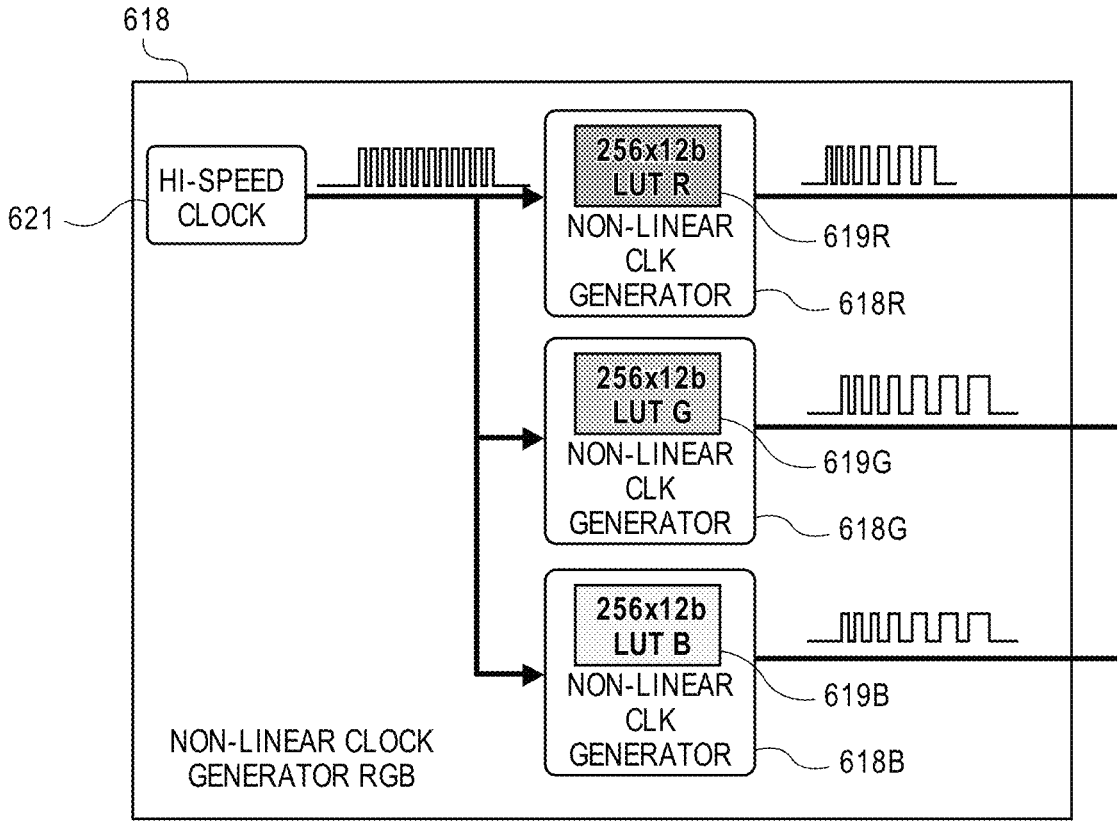
FIG. 6 is a close up view illustration of a non-linear clock generator according to one embodiment of the disclosure.

FIG. 6 is a close up view illustration of a non-linear clock generator 618 in accordance with an embodiment. In the embodiment illustrated in FIG. 6, non-linear clock generator 618 includes a (e.g. hi-speed) clock 621 that loads clock data into individual non-linear clock generators 618R, 618G, 618B, with each non-linear clock generator including one or more corresponding look-up tables (LUT), e.g., a red (R) light emitting element LUT 619R, a green (G) light emitting element LUT 619G, and a blue (B) light emitting element LUT 619B. The look-up tables LUT 619R, LUT 619G, LUT 619B store data for how much longer the clock 621 pulses (e.g., expressed in 200 MHz clock cycles) become for each grey level. As illustrated, each non-linear clock generator 618R, 618G, 618B may provide a separate non-linear clock pulse signal for each corresponding light emitting element R, G, B.

Figure 7:
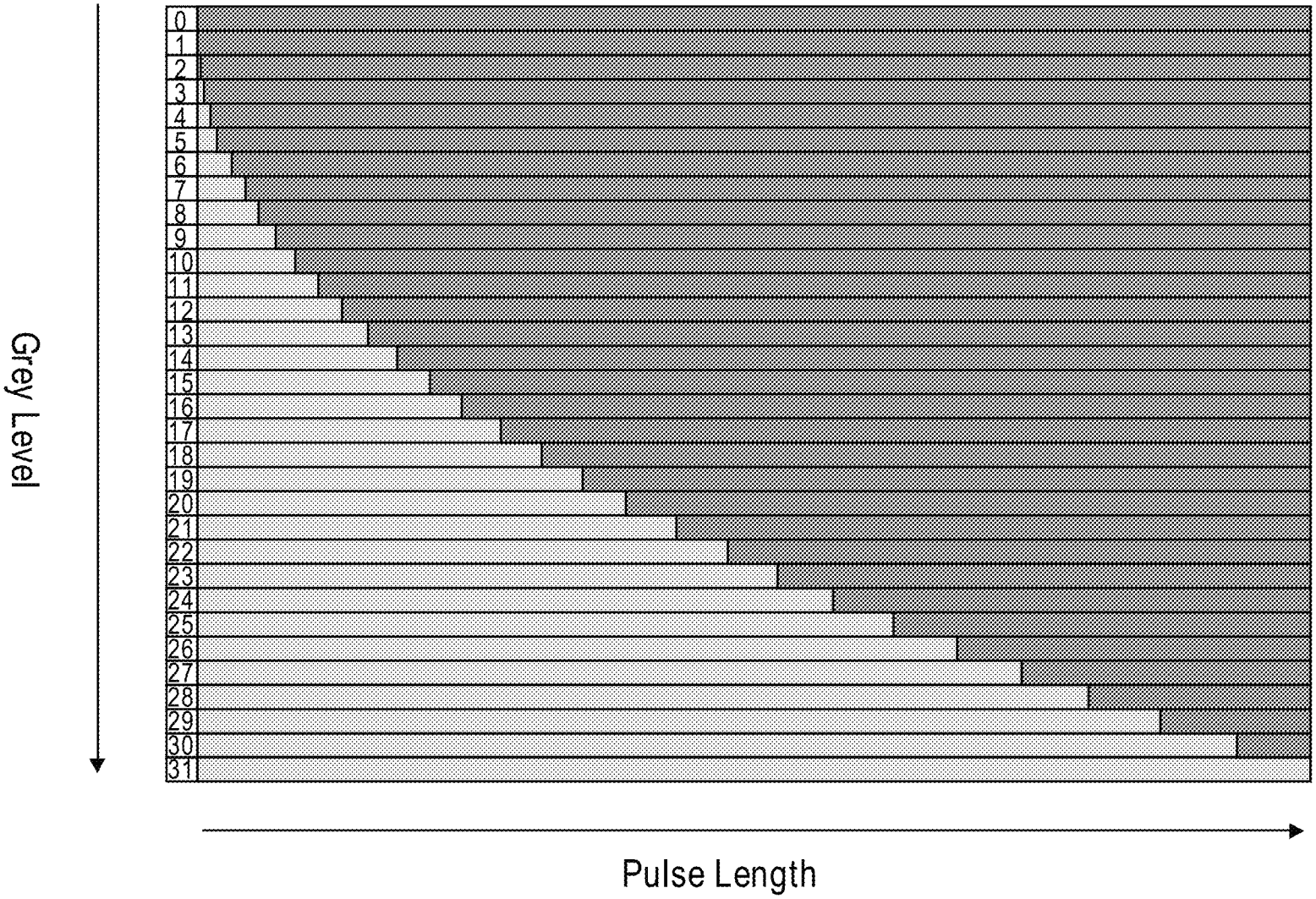
FIG. 7 is a non-linear time versus gray level diagram according to one embodiment of the disclosure.

A signal from a gray scale clock may be a series of (e.g., non-linear) pulses, for example, of varying duration of time but at the same amplitude. Gray scale clock may allow gray scale control in the time domain. Each single pulse of a gray scale clock may non-linearly correspond to different gray scale levels, e.g., such that each emission pulse becomes progressively longer for higher gray levels. FIG. 7 is a non-linear time versus gray level diagram for an exemplary 5 bit counter value (e.g., 32 gray levels) although a counter may be any size (e.g., with corresponding gray levels). In one embodiment, different widths of pulses correspond to the same gray scale levels for respective (e.g., different colored) display elements. For example, as shown in the example in FIG. 6, each non-linear clock generator 618R, 618G, 618B emits separate signal pulses for different colored display elements. As shown in the example in FIG. 5, in an embodiment the non-linear clock generator 518 may emit separate signal pulses for the red emitting display elements, based upon the red LUT 519, and another signal pulse for both the green and blue emitting display elements, based upon the green and blue LUT 519G/B. Referring back to the EQE curves expressed in FIG. 1, this may be possible due to the similar EQE curves for the green and blue micro LEDs.

In the embodiments illustrated and described thus far with reference to FIGS. 4-6, gamma correction is performed by the non-linear clock generator(s) on the emission controller 402, 502, rather than at each micro driver (e.g., 411, 511). Accordingly, video data (e.g., 8 bit) can be stored uncorrected on the microdrivers. Performing gamma correction with the non-linear clock generator(s) may help minimize the microdriver chip size, facilitating higher density pixels per inch in the active area, since circuit size and complexity is not necessary for higher bit logic. Power reduction may additionally be realized, with less data clock cycles for loading data, and less grey level clock transitions.

Figure 8:
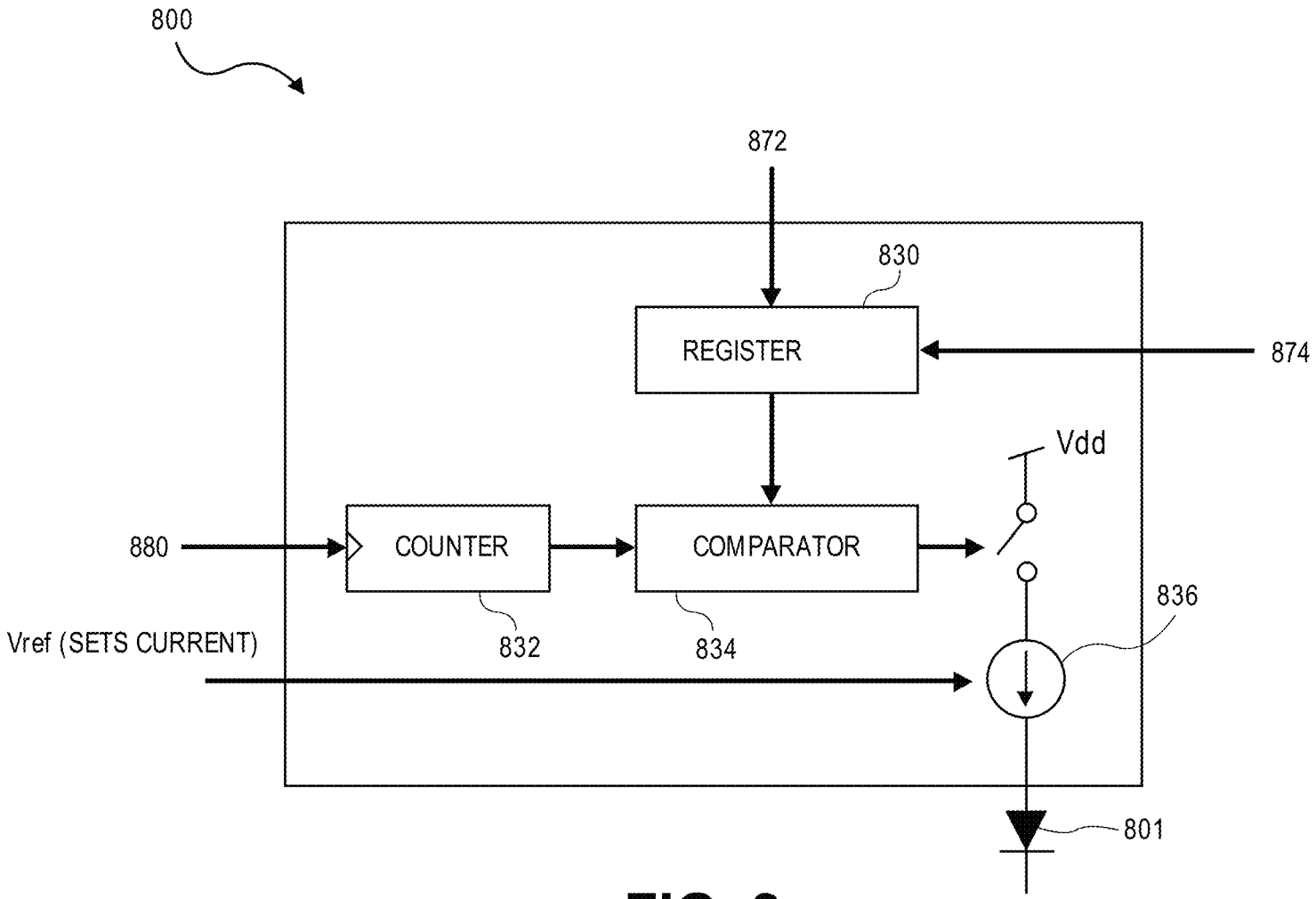
FIG. 8 is a unit cell of a microdriver according to one embodiment of the disclosure.
Figure 9:
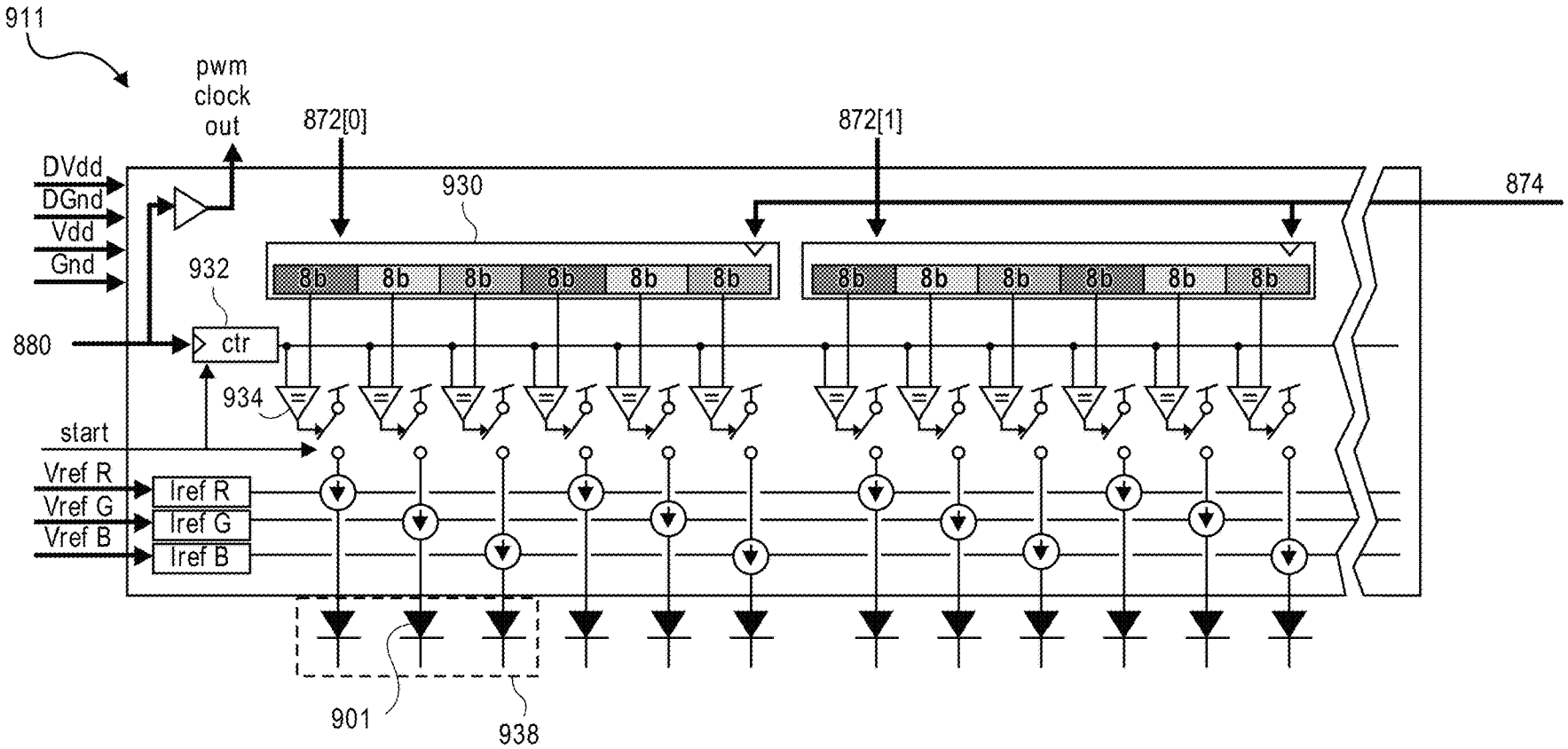
FIG. 9 is a microdriver according to one embodiment of the disclosure.

FIG. 8 is a unit cell 800 of a microdriver according to one embodiment of the disclosure. FIG. 9 is a microdriver 911 according to one embodiment of the disclosure. In the following discussion, microdriver 911 may be any of the microdrivers described herein, (e.g. 111, 411, 511). Micro driver 911 may include one or more unit cells (e.g., 800). A microdriver (e.g., 111, 411, 511, 911) may include one or more components of unit cells (e.g., 800). Depicted unit cell 800 includes a register 830 (e.g., digital data storage device) to store a data 872 signal corresponding to the emission to-be-output from the display element (e.g., LED 801). Data stored in a register may be referred to as digital data, e.g., in contrast to analog data stored in a capacitor. Data 872 (e.g., video) signal may be loaded (e.g., stored) into the register by any method, for example, by being clocked in according to a data clock 874. In one embodiment, the data clock 874 signal being active (e.g., goes high) allows data 872 to enter the register and then the data is latched into the register when the data clock signal is inactive (e.g., goes low). A signal (e.g., non-linear) gray scale (e.g., level) clock 880 may increment a counter 832. Gray scale clock 880 may also reset the counter to its original value (e.g., zero).

Unit cell 800 also includes a comparator 834. Comparator may compare a data signal from the register 830 to a number of pulses from a (e.g., non-linear) gray scale clock 880 counted by counter 832 to cause an emission by display element (e.g., LED 801), e.g., when the data signal differs from (e.g., or is greater or less than) the number of pulses from the non-linear gray scale clock. Depicted comparator may cause a switch to activate a current source 836 to cause the display element (e.g., LED 801) to illuminate accordingly. A current source (e.g., adjusted via an input, such as, but not limited to a reference voltage (Vref) may provide current to operate a display element (e.g., μLED) at its optimum current, e.g., for efficiency as described with regard to FIG. 1. A current source may have its current set by a control signal, such as a bias voltage setting the current, use of a (e.g., Vth) compensation pixel circuit, or adjusting a resistor of a constant current operational amplifier (opamp) to control the output of the opamp's current.

FIG. 9 is a microdriver 911 according to one embodiment of the disclosure. Microdriver 911 may be utilized as a microdriver in a display system. Microdriver 911 includes multiple of certain components of a unit cell 800. Although a single counter 932 is depicted, each display element or each group of (e.g., same or similar colored) display elements may have its own counter (e.g., and its own non-linear PWM clock). Other components may function as in the description of FIG. 8. Emission controller may provide the (e.g., input) signals in FIG. 9. Display data (e.g., data 0 and data 1 in FIG. 9) may be provided by emission controller, e.g., as sourced from video or other visual content. Each current source for a display element(s) or a group of (e.g., same or similar colored) display elements may receive a control signal (e.g., from emission controller) and output a constant current when on. The current of a current source may be set during manufacture (e.g., once) or it may be dynamically adjustable (e.g., during use of the display system). Each pixel (e.g., 938) may have its own microdriver. Register 930 may be a vector register, e.g., such that each element of vector stores the data signal for its particular display element.

Figure 10:
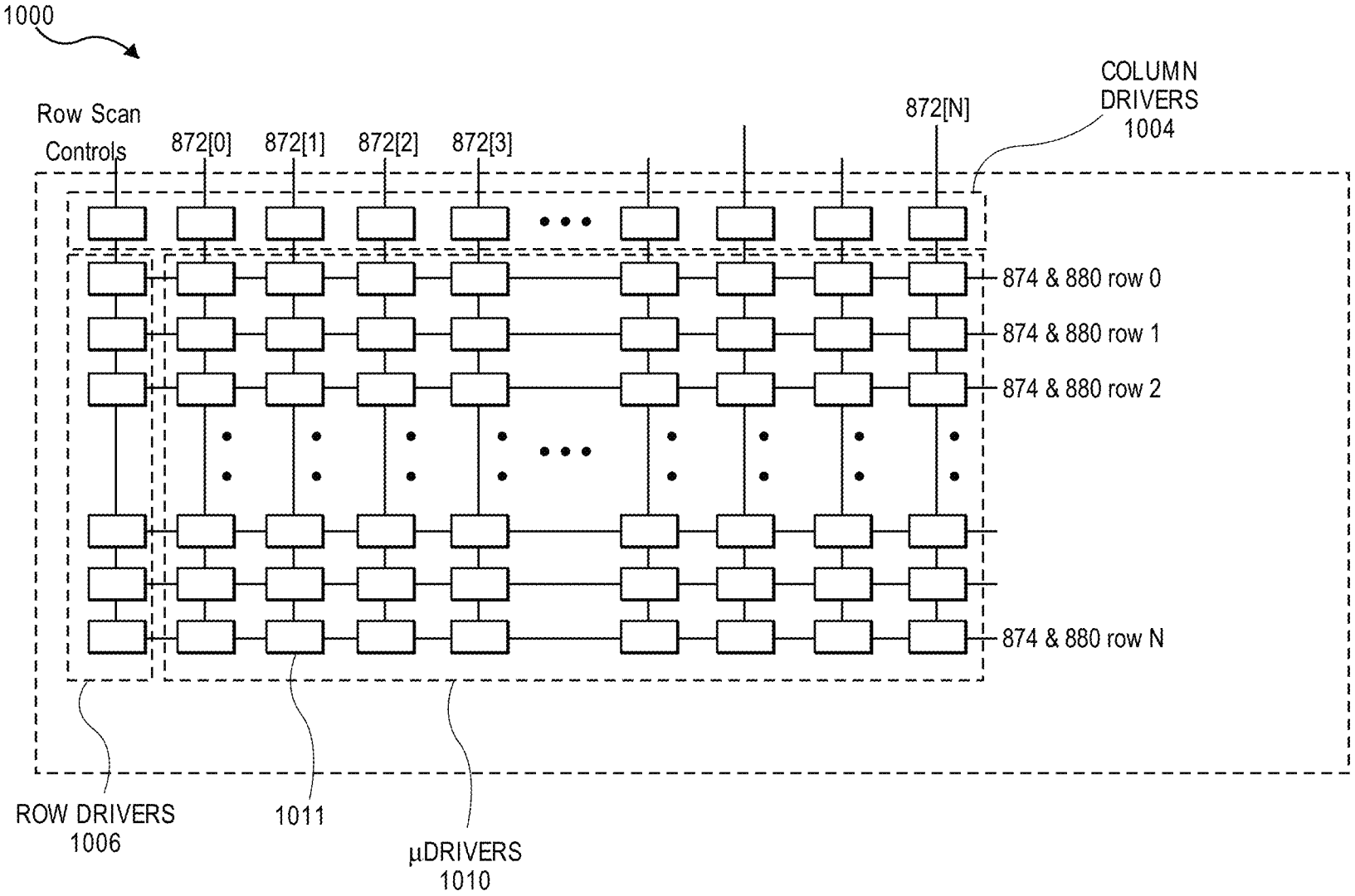
FIG. 10 is a block diagram of a display system according to one embodiment of the disclosure.

Referring now to FIG. 10, a block diagram is provided of a display system 1000 according to one embodiment of the disclosure. Active (e.g., display) area 1010 includes multiple microdrivers (e.g., microdriver 1011 as an example). A microdriver may selectively illuminate its corresponding display element(s) (e.g., LED(s)). Display system 1000 may (e.g., via an emission controller, not shown) include column driver(s) 1004 and/or row driver(s) 1006. Column drivers 1004 may include individual drivers for each column. Row drivers 1006 may include individual drivers for each row. In one embodiment, column driver(s): provide electrostatic discharge (ESD) protection for the interface signals, e.g., that are exposed to the external world, provide buffering for the incoming data 872 (e.g., 872 [column number]) and row scan controls (e.g., data clock 874 and emission (gray scale) clock 880); provide emission column selection signals to turn on and off a column or columns selectively; and/or perform analog muxing for emission current read-out. Each column driver may control one microdriver column (e.g., which may be equivalent to four display element (e.g. pixel) columns).

In one embodiment, row driver(s) (e.g., placed along the left or right edge of the active area 1010): provide ESD protection for row routings during display element (e.g., LED) transfer process; for example, based on incoming row scan controls, generate a data clock 874 signal for each display row, e.g., which may be used as the latching clock of incoming data 872 in each microdriver; and/or for example, based on incoming row scan controls, generate gray scale clock 880 signal for each display row, e.g., which may be used for emission control in each microdriver. In an embodiment, each row driver may control one display element (e.g. pixel) row.

In one embodiment, microdriver(s): latch the (e.g., pixel) values on the data 872 routing, for example, coming from column drivers and/or use the data clock 774 signal, which may come from the row drivers, to count the number of emission (e.g., gray scale) clock 880 pulses up to the received pixel value for each subpixel, for example, to control each display element's (e.g., LED's) luminance as a function of gray code (e.g., by a PWM method).

Figure 11:
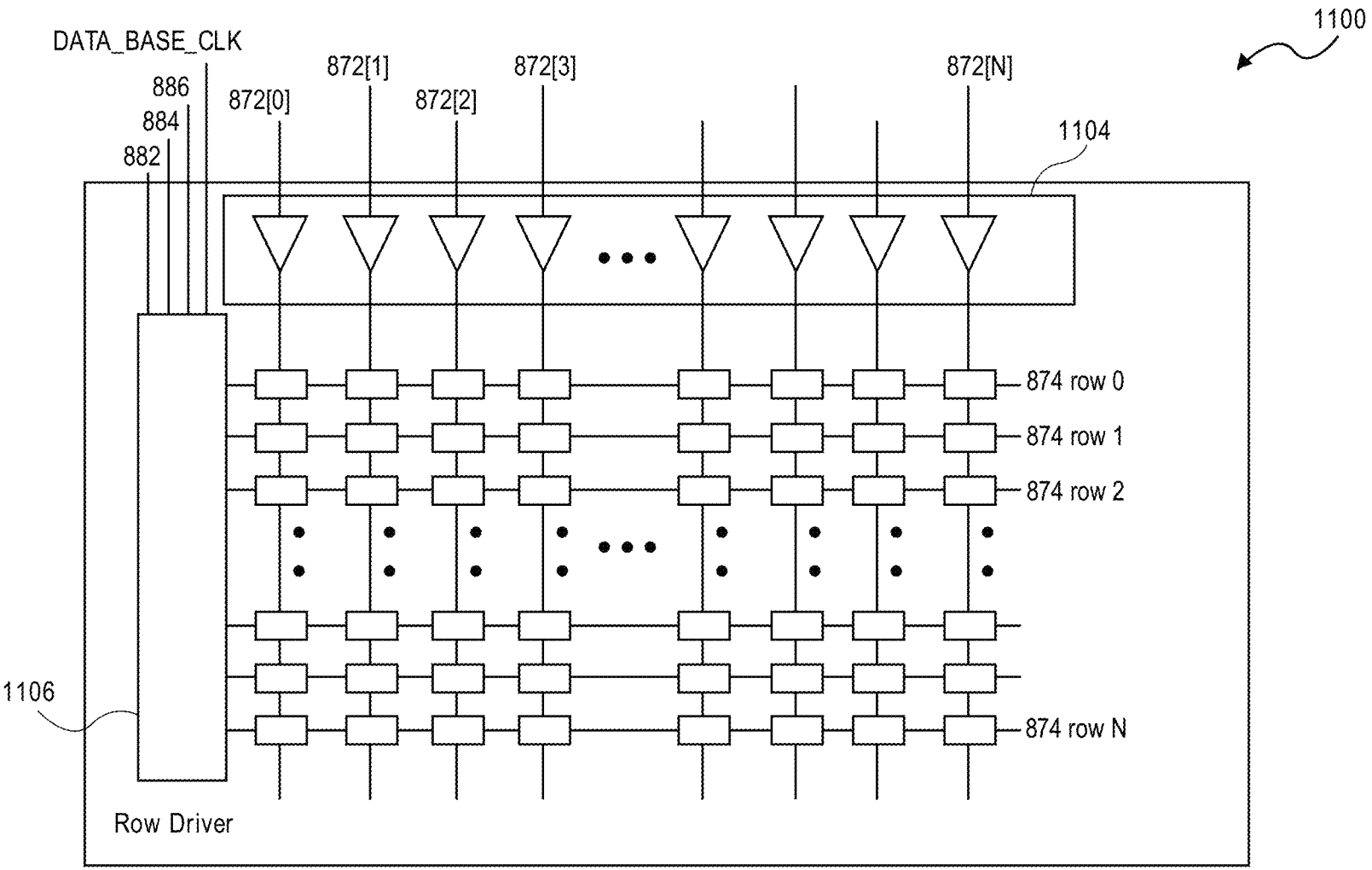
FIG. 11 is a diagram of pixel data distribution according to one embodiment of the disclosure.

FIG. 11 is a diagram of pixel data distribution 1100 according to one embodiment of the disclosure. Data scan may be based on the raster scan by using the vertical data 872 signals (e.g., generated by the emission controller and/or buffered by the column drivers 1104) and the horizontal data clock 874 signals (e.g., generated by the row drivers 1106 using the scan control signals from the emission controller). Data 872 signals may contain the (e.g., pixel) data signals for the microdrivers (e.g., generated by the emission controller and/or buffered by column drivers). Each column driver may provide data for one column of microdrivers, which may correspond to multiple (e.g., 4) columns of display elements (e.g., pixels). Row drivers 706 may generate the data clock 874 for each display row, and each microdriver may use the incoming data clock 874 to latch the incoming data 872 from the column drivers 704.

Row drivers together may form a shift register to generate the data clocks 874. The data clock shift register may be composed of a 1st stage shift register, a 2nd stage latch, and a 3rd stage clock gating array. The 1st stage may be controlled by scan shift clock 882 signal (e.g., from row scan shift register clock) and scan start 884 signal (e.g., row scan start). Panel clock 886 signal (e.g., from row scan latch clock) may be used to load the contents of the 1st stage to the 2nd stage latch.

Figure 12:
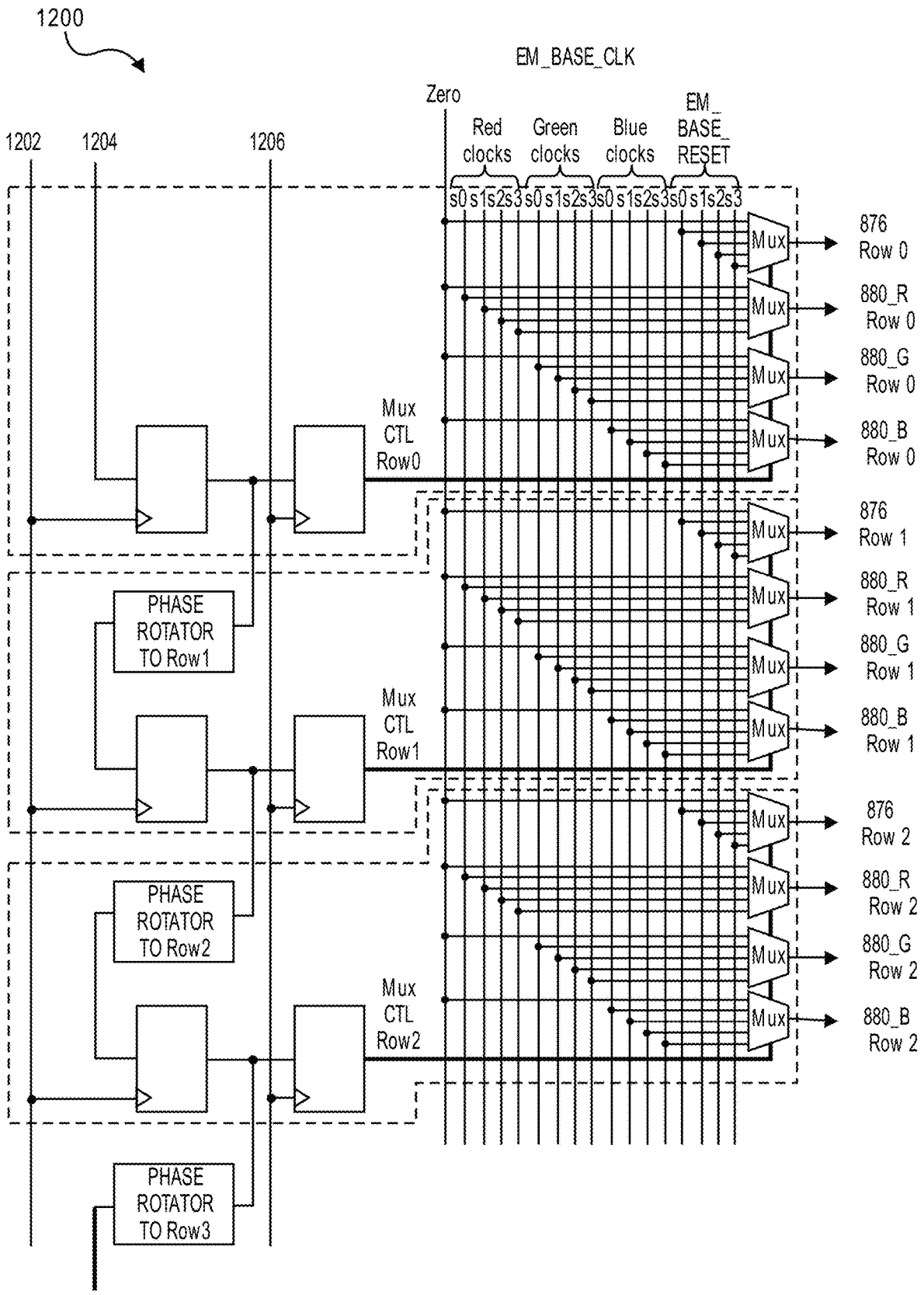
FIG. 12 is a block diagram of emission clock row drivers according to one embodiment of the disclosure.
Figure 13A:
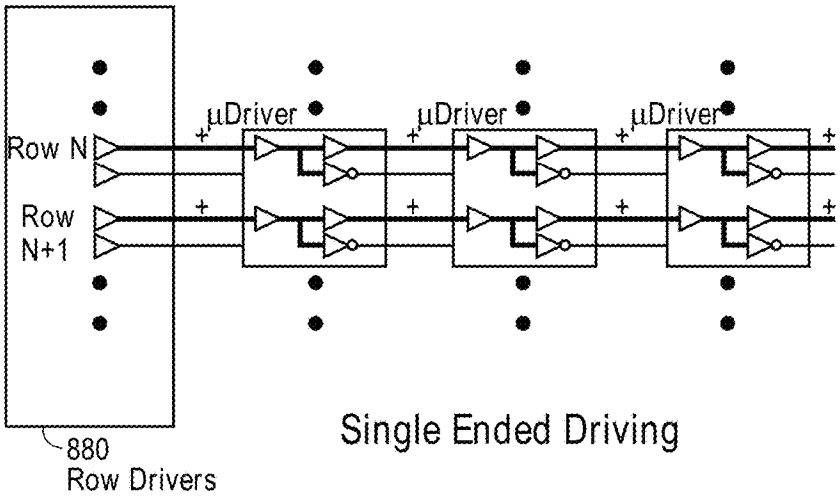
FIGS. 13A-13D are clock polarity options according to one embodiment of the disclosure.
Figure 13B:
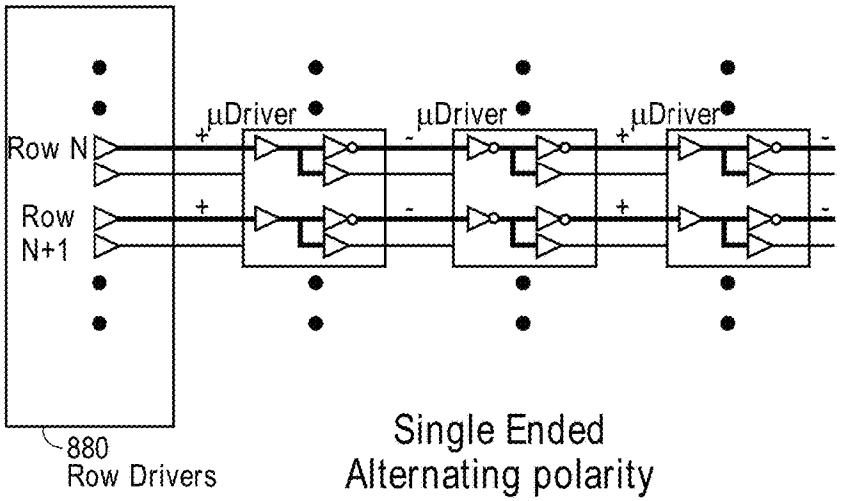
Figure 13C:
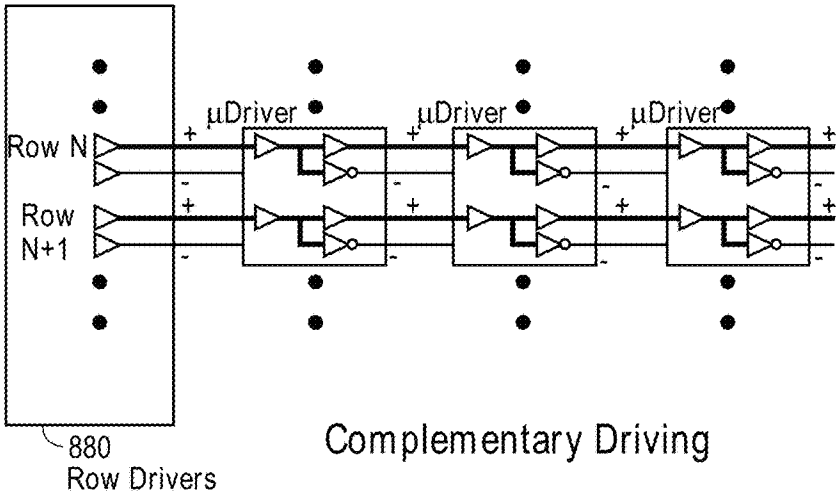
Figure 13D:
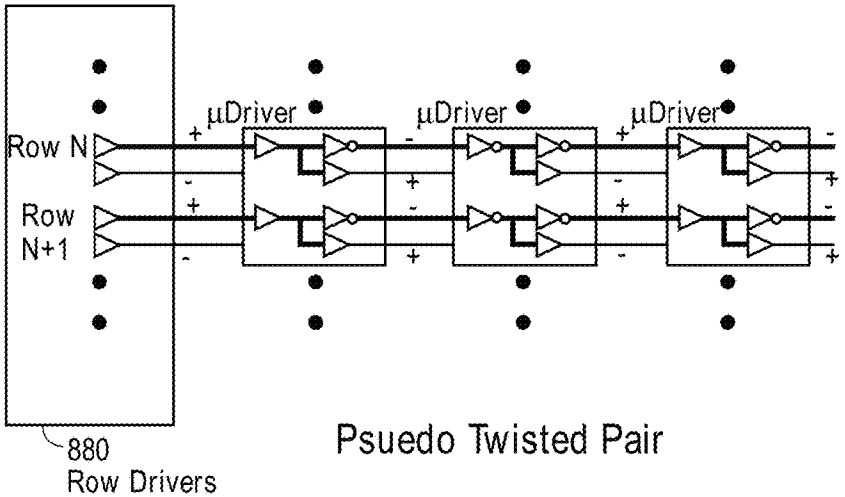

FIG. 12 is a block diagram of emission clock row drivers 1200 according to one embodiment of the disclosure. Dashed lines show the outlines of individual row drivers in this embodiment. Depicted row drivers form a shift register to drive the emission (e.g., gray scale) clock pulses (e.g., emission clocks 880) provided to the rows of microdrivers. See, for example, FIG. 10. Microdrivers may use emission clock 880 as the basis of PWM pulse generation, e.g., to produce the required luminance output corresponding to the digital pixel data. The shift register for emission clock 880 generation may be composed of the 1st stage shift register, the 2nd stage latch, and the 3rd stage mux array. The 1st stage shift register may be driven by emission row start shift register clock 1202 and emission row start shift register input 1204. Emission row start latch clock 1206 may latch the content of the 1st stage to the 2nd stage. In (e.g., default) operation, 1202, 1204, and 1206 can all operate at the nominal line rate (e.g., nominal line times roughly 40 μs at a 60 Hz data refresh rate), but it may also be possible to operate 1202 and 1204 at (e.g., much) higher speed, e.g., to allow the loading of arbitrary pattern to the 1st stage in one line time. S_VST and Mux control (CTL) may be a 3-bit signal, for example, where the most significant bit (MSB) controls emission on and off, and the 2 least significant bits (LSBs) denote the emission phase (Φ), e.g., as described in Table 1 below. The bit marked with an "x" may be either 0 or 1.

TABLE 1

Mux Output Truth Table

| Mux CTL (binary) | Mux output |
|---|---|
| 0xx | 0 |
| 100 | Φ0 |
| 101 | Φ1 |
| 110 | Φ2 |
| 111 | Φ3 |

Depicted phase rotator is placed between each row of the 1st stage shift register, e.g., to simplify the loading of the 1st stage for the (e.g., typical) usage cases, where each successive row or each successive block of rows may emit with a staggered phase from the previous row or the previous block of rows, respectively. Each row driver may have a phase rotation control which operates according to Table 2.

TABLE 2

Phase Rotator Operation

| Phase rotator input | Phase rotation control = 1 | Phase rotation control = 0 |
|---|---|---|
| 0xx | 0xx | 0xx |
| 100 | 101 | 100 |
| 101 | 110 | 101 |
| 110 | 111 | 110 |
| 111 | 100 | 111 |

Figure 14:
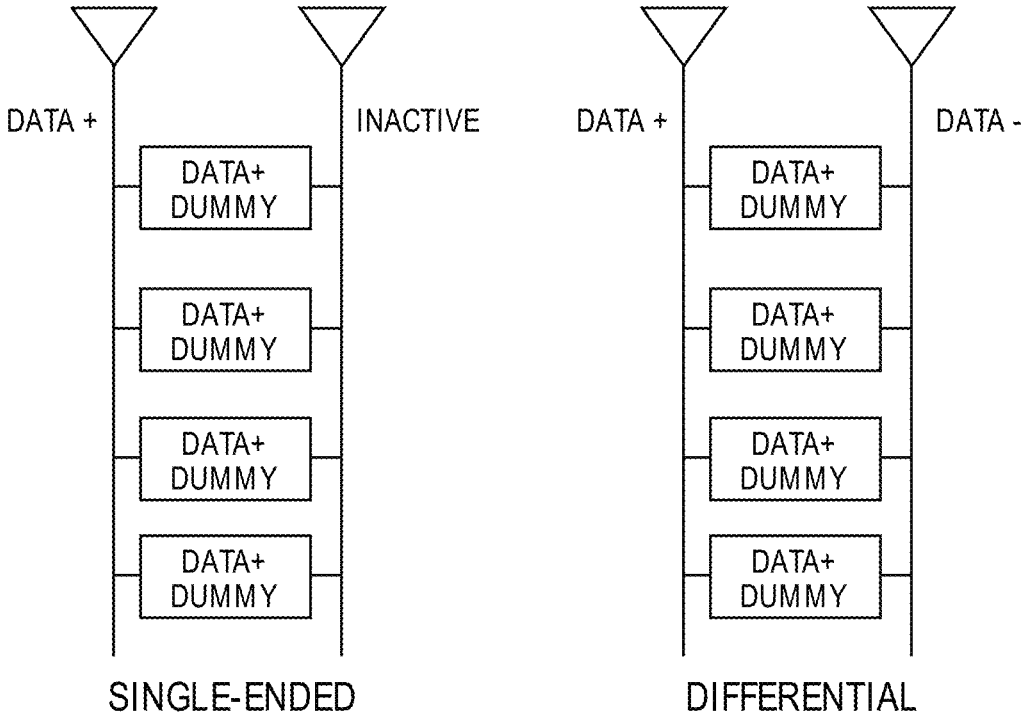
FIG. 14 illustrates single-ended and differential modes of column driving according to one embodiment of the disclosure.

Emission clock 880 output from each row driver and/or microdriver may have an option (e.g., via phase rotation control signal) to drive either single-ended or differential and/or to compare electromagnetic interference (EMI) performance, e.g., to minimize the EMI. FIG. 14 illustrates single-ended and differential modes of column driving for individual column drivers (see, e.g., FIG. 10) according to one embodiment of the disclosure. Additionally or alternatively, this may be utilized for individual row drivers (see, e.g., FIG. 10) in a single-ended or a differential mode. In one embodiment, each microdriver shall have the option of inverting the incoming emission clock 880 before using it for internal logic and/or before relaying to the next microdriver. By combining the two options, the following 4 clock polarity options in FIGS. 13A-13D may be supported, e.g., to compare EMI performance. Note that for the single-ended alternating polarity and the pseudo twisted pair, every other microdriver (e.g., odd or even columns) may utilize an inverted, incoming emission clock signal, for example, including an option to invert the incoming emission clock signal.

Figure 15:
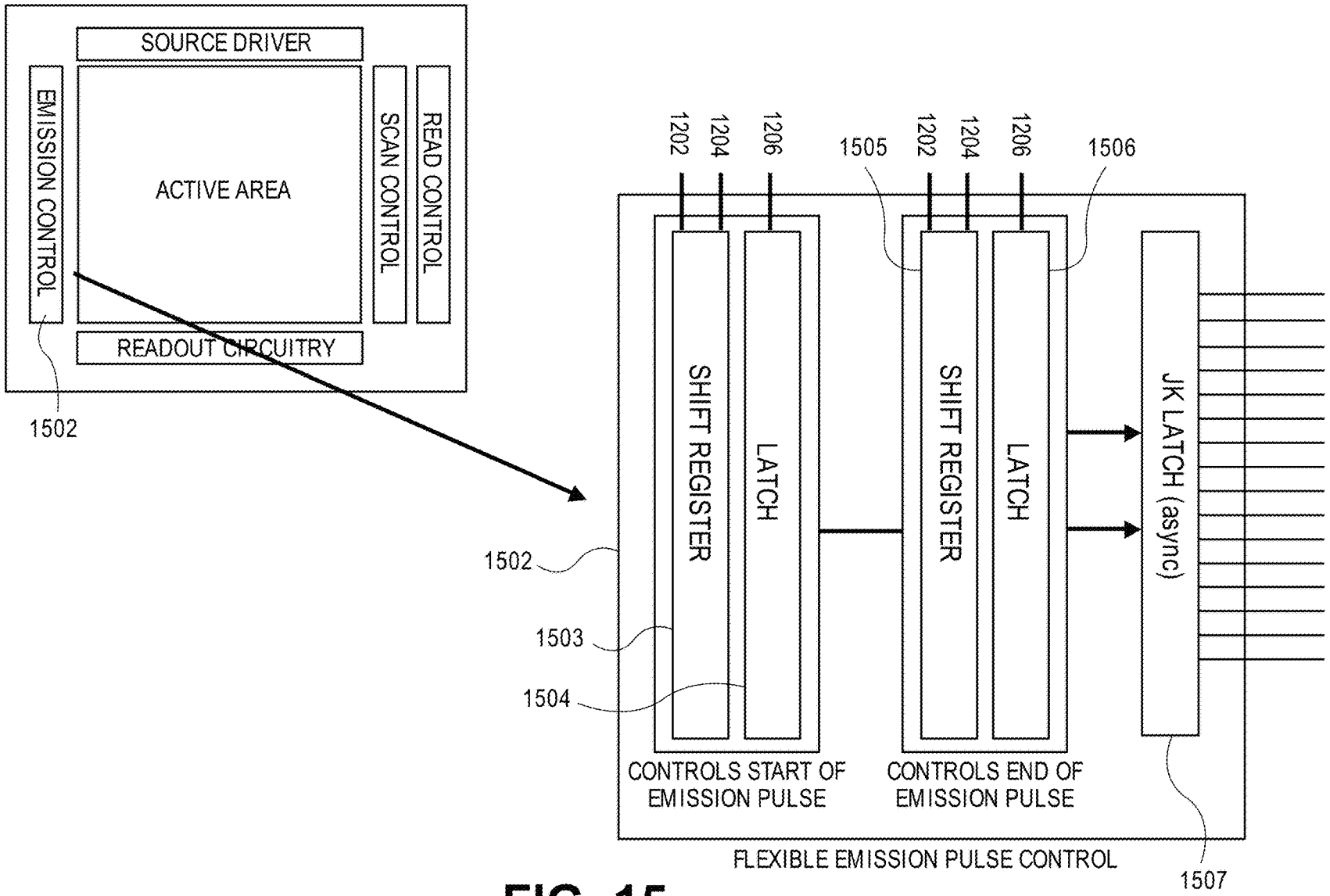
FIG. 15 is an emission pulse controller according to one embodiment of the disclosure.
Figure 16:
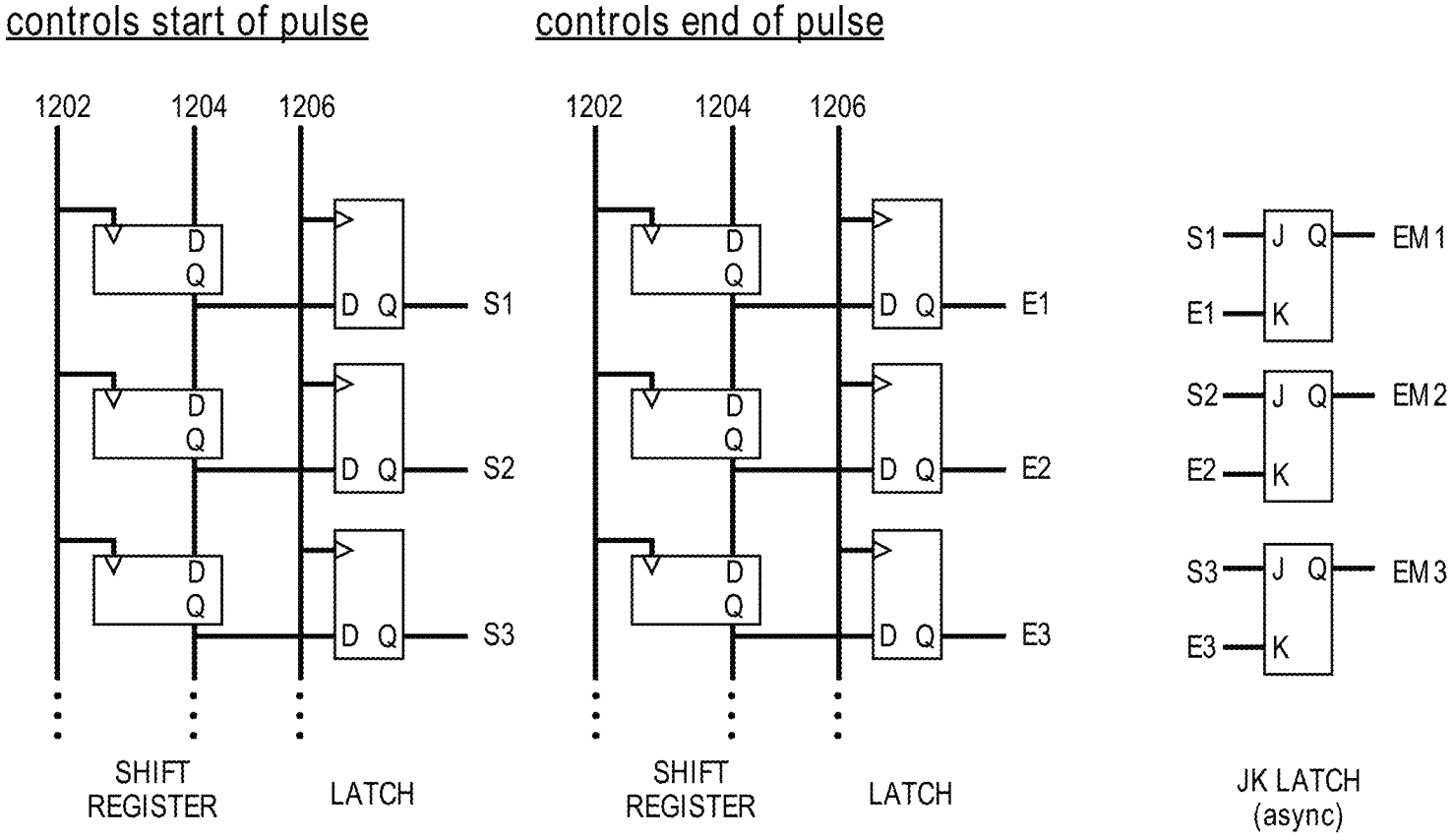
FIG. 16 is a pulse control circuit according to one embodiment of the disclosure.

FIG. 15 is zoomed in view of an emission pulse controller 1502 according to one embodiment of the disclosure. FIG. 16 is a pulse control circuit 1600 according to one embodiment of the disclosure. Referring to FIGS. 15-16, a (e.g., row) emission control may provide control of the start- and end-time of the emission pulses by using a combination of shift registers and latches. The depicted (e.g., row) driver consists of the following components (e.g., one for each color channel). Start logic: a shift register 1503 with a latch 1504 may generate a pulse for a group (e.g., rows). The edge of the pulse may indicate the emission start time for the display elements (e.g., sub-pixels) within the group (e.g., row, such that it does not affect the emission of any other rows). End logic: similar to the start logic with a shift register 1505 and a latch 1506, but the rising edge of its output pulse may signify the end time for the emission pulse within the group (e.g., rows). Asynchronous JK Latch 1507 may keep track of the state for each group (e.g., row). The pattern clock in the shift registers, e.g. shift register inputs 1204, may set the number of display elements (e.g., rows) within one group. The shift register clocks 1202 may shift the pattern with the line frequency (e.g., about 1/10 μs), but the shift frequency could go up to 100 MHz. The select latch clocks 1206 may specify the exact location of the emission pulse edges. This signal may have a fine precision (e.g., about 10 ns). All 6 of these input signals (per color) may be generated by the emission controller (e.g., a timing controller (TCON) thereof). The shift registers may be bi-directional (not shown in drawings), e.g., to provide more flexibility. The red (R), green (G), and blue (B) may include channels that have individually controllable pulse widths. Thus the emission control circuitry may thus be multiplied by three or, multiplied by two when the circuits for green and blue are grouped together. The above may be used for row control by an emission controller. Column control by an emission controller may include a bi-directional shift register in which the column pattern is clocked in and moved serial through, e.g., left to right through column control drivers 1004 in FIG. 10. This may control which of the columns are emitting at a certain moment in time.

Figure 17:
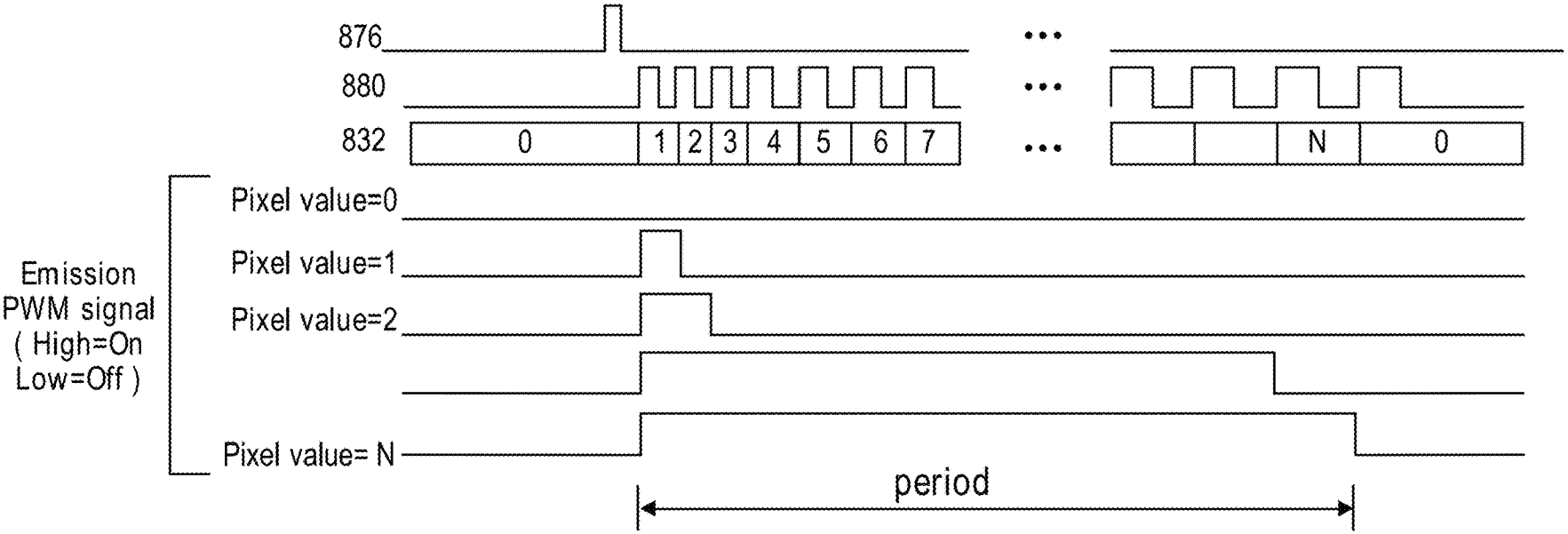
FIG. 17 is an emission pulse width modulation (PWM) control timing diagram according to one embodiment of the disclosure.

FIG. 16 is an emission pulse width modulation (PWM) control timing diagram according to one embodiment of the disclosure. Each (e.g., unit cell or other grouping of a) microdriver may utilize a gray level (e.g., emission (EM)) counter 832, for example, for each color. The emission counter 832 may be toggled by the emission clock 880 signal (e.g., FIG. 17 illustrating the non-linear nature of that signal) and reset by emission counter reset 876. For each display element (e.g., pixel), there may be an emission PWM control block (e.g., a comparator) to compare the emission counter value with the stored (e.g., pixel) data to turn on the display element (e.g., μLED) emission for a specified number of emission clock periods. In one embodiment, the emission counter may count (e.g., from 0 to 255) in increments of one and produce a corresponding emission PWM signal (pulse), for example, as shown in FIG. 17. See also FIGS. 7-8 and the associated text. Microdriver may turn on and off the emission column by column. This column and/or row select feature may be used to implement various emission patterns, not only in row-by-row fashion (e.g., controlled by the emission clock) but also in column-by-column fashion, or a combination of row(s) and column(s), e.g., to control individual display elements.

Figure 18:
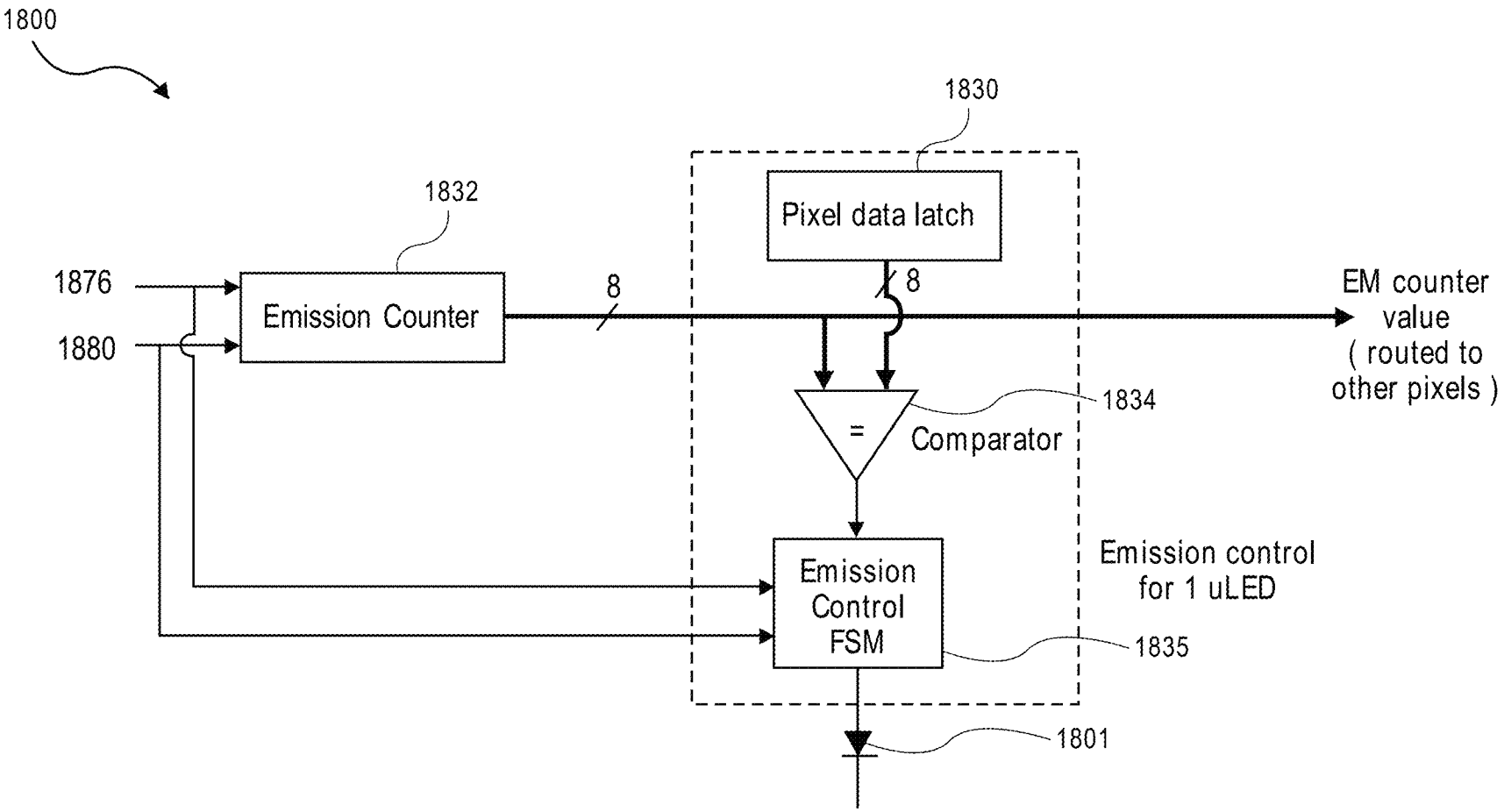
FIG. 18 is a block diagram for emission control according to one embodiment of the disclosure.

FIG. 18 is a block diagram for emission control 1800 according to one embodiment of the disclosure. Emission control 1800 may be part of a unit cell and/or emission controller. Depicted circuit (e.g., unit cell and/or microdriver) includes a (e.g., hardware) counter 1832 with a gray scale clock input (e.g., as emission clock 1880 signal) for each display element 1801 (e.g., a group of display elements) to count the incoming emission clock edges to generate the pulse-width modulation (PWM) signal to control the luminance of each display element 1801 (e.g., μLED). Depicted circuit also includes a reset input (e.g., as emission counter reset 1876 signal) on the counter 1832, e.g., to reset the counter to zero. Gray scale clock counter's value may be routed to other display elements (e.g., pixels). The data signal (e.g., for the data to be displayed) may be stored in a register (e.g., pixel data latch 1830) and compared with a comparator 1834 against the number of pulses stored in the emission counter 1832 to cause an output of light until the comparator indicates the emission has reached the value indicated by the data signal. There may be different modes of operation, e.g., a circuit capable of operating in either of two modes. Mode 0 may include the emission counter counting from an initial value (e.g., 0) to a maximum value (e.g., 255) to generate a (e.g., 8-bit) PWM pattern in each (e.g., 4.17 ms) period. Mode 0 is illustrated and described with regard to FIGS. 17-18. Mode 1 is described below in reference to FIGS. 24-26. When emission counter reset 1876 is asserted, the emission counter 1832 may be reset to 0 and the emission for each connected display element (e.g., LED) turned off. The emission counter may increment on each incoming emission clock 1880 rising edge. The emission for each connected display element (e.g., LED) may starts at the first emission clock after emission counter reset and may finish (e.g., turn off) when the emission counter matches the data (e.g., pixel) value. A hardware emission controller may control the non-uniform cycle time of the emission clock 1880, e.g., so that the resulting PWM pattern matches the desired gray-level versus luminance curve.

Instead of a comparator connecting to a current source (e.g., as in FIG. 8), comparator may connect to a finite state machine (FSM), e.g., to further control the output. FSM may take other inputs, for example, an output select input, e.g., as described below in reference to FIGS. 19-21.

Figure 19:
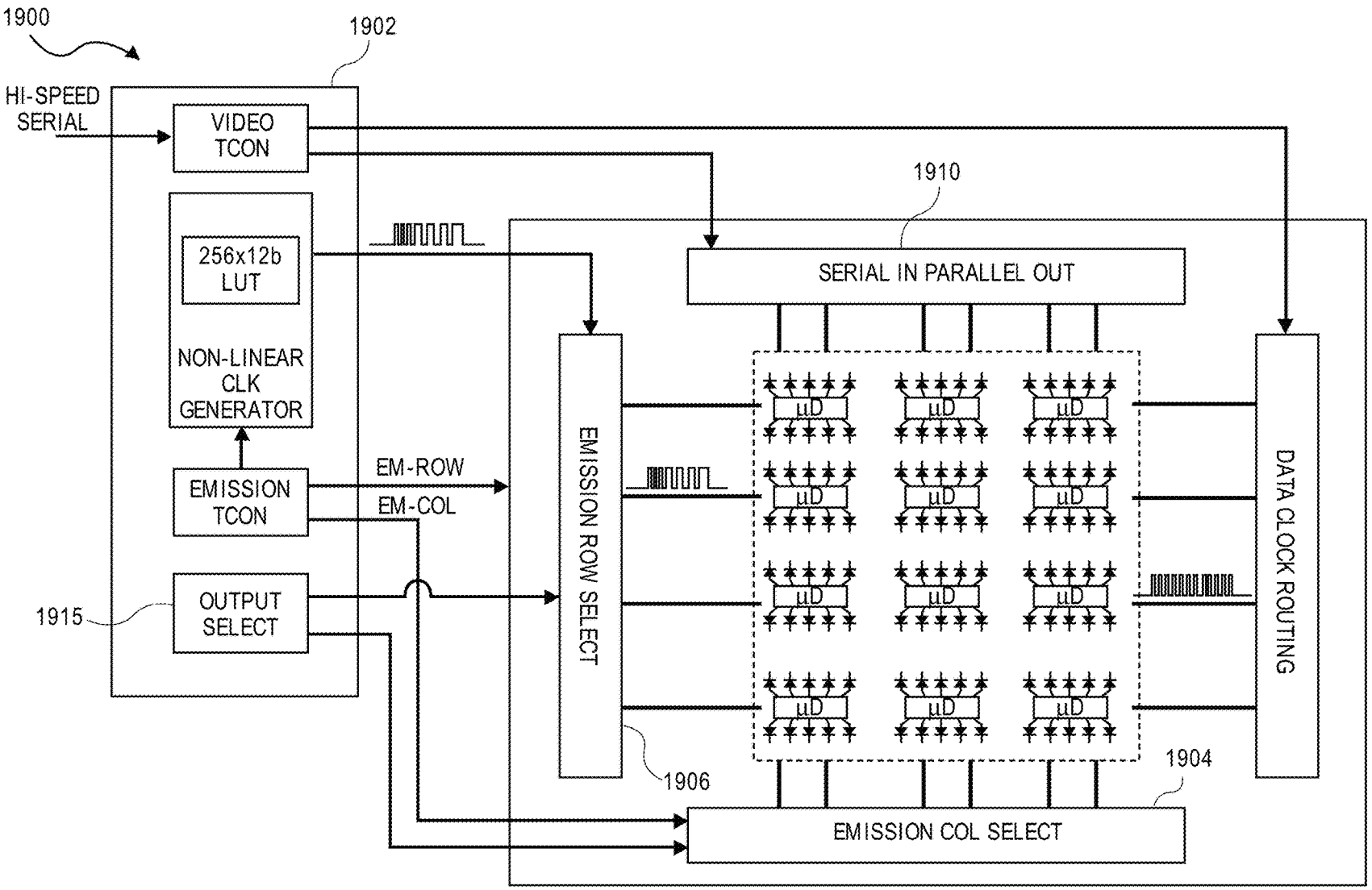
FIG. 19 is a display system according to one embodiment of the disclosure.

In certain embodiments, an emission controller may utilize an additional output select signal to further control the emission of each or a group of display elements (e.g., LEDs). FIG. 19 is a display system 1900 according to one embodiment of the disclosure and includes an output select module 1915 to provide an output select signal. The output select module 1915 and routing to a group of display elements may be referred to as a timing offset circuit. Output select module may provide an output select signal to each, all, or a group less than all of the display elements (e.g., a pixel). Depicted output select module 1915 may provide an output select signal to each, all, or a group of less than all of the display elements (e.g., a pixel) through a row driver (e.g., 106 in FIG. 2 or 1906 in FIG. 19) and/or a column driver (e.g., 104 in FIG. 2 or 1904 in FIG. 19). In one embodiment, an emission controller may connect directly to a display element or microdriver.

An output select feature may be used to achieve a desired (e.g., low) emission duty cycle, e.g., without requiring (e.g., very) relatively short emission clock cycles, as explained in the following. For example, in an embodiment with a 240 Hz emission cycle with 1% emission duty, a 240 Hz emission cycle as a sub-frame and a 60 Hz cycle as a frame, in each of the 4 sub-frames in a 60 Hz frame the emission controller may turn on only one out of every 4 columns. After 4 sub-frames, every display element (e.g., pixel) in this example may have emitted exactly once for 41.6 μs. Without the output select feature, all pixels may have emitted for each pulse (e.g., 4 times) in each frame, e.g., each time for 10.4 μs. Note that this emission time may be for the highest gray level, and the emission time for the lowest gray level may be (e.g., much) shorter due to the resistance and capacitance (RC) time constant of the offset timing circuit.

Figure 20:
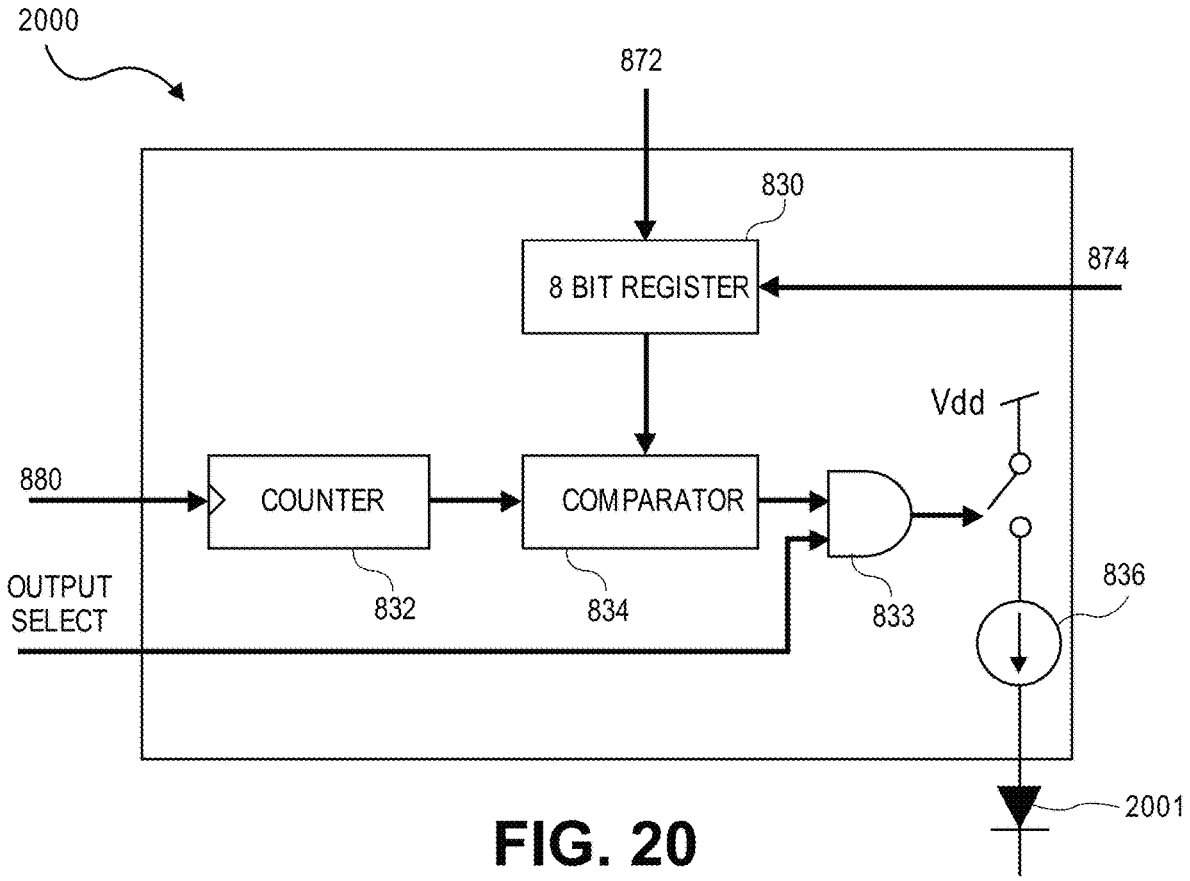
FIG. 20 is a unit cell of a microdriver according to one embodiment of the disclosure.

FIG. 20 is a unit cell 2000 of a microdriver according to one embodiment of the disclosure. FIG. 20 may operate similarly to the unit cell in FIG. 8, however the output of the comparator may not go directly to the display element (e.g., LED 2001). Thus instead of depicted comparator causing a switch to activate a current source 836 to cause the display element (e.g., LED 2001) to illuminate with no further input(s), a circuit (depicted as an AND gate 833) may only allow the display element to illuminate when both the comparator and an output select signal are high (e.g., 1 in binary). Although an AND gate is depicted, it may be replaced with a FSM, e.g., including "output select" or other signals as inputs for the states.

Figure 21:
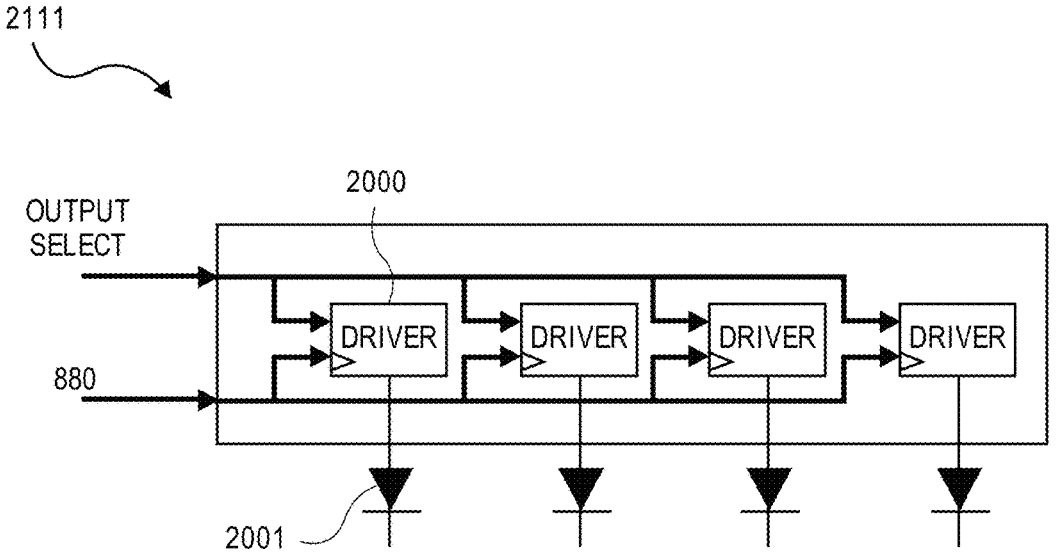
FIG. 21 is a microdriver including multiple unit cells according to one embodiment of the disclosure.

FIG. 21 is a microdriver 2111 including multiple unit cells (e.g., 2000) according to one embodiment of the disclosure. FIG. 21 depicts an output select signal being shared by multiple display elements (e.g., LED 2001). In one embodiment, each unit cell or display element may receive its own (e.g., independent) output select signal from an emission controller.

Figure 22A:
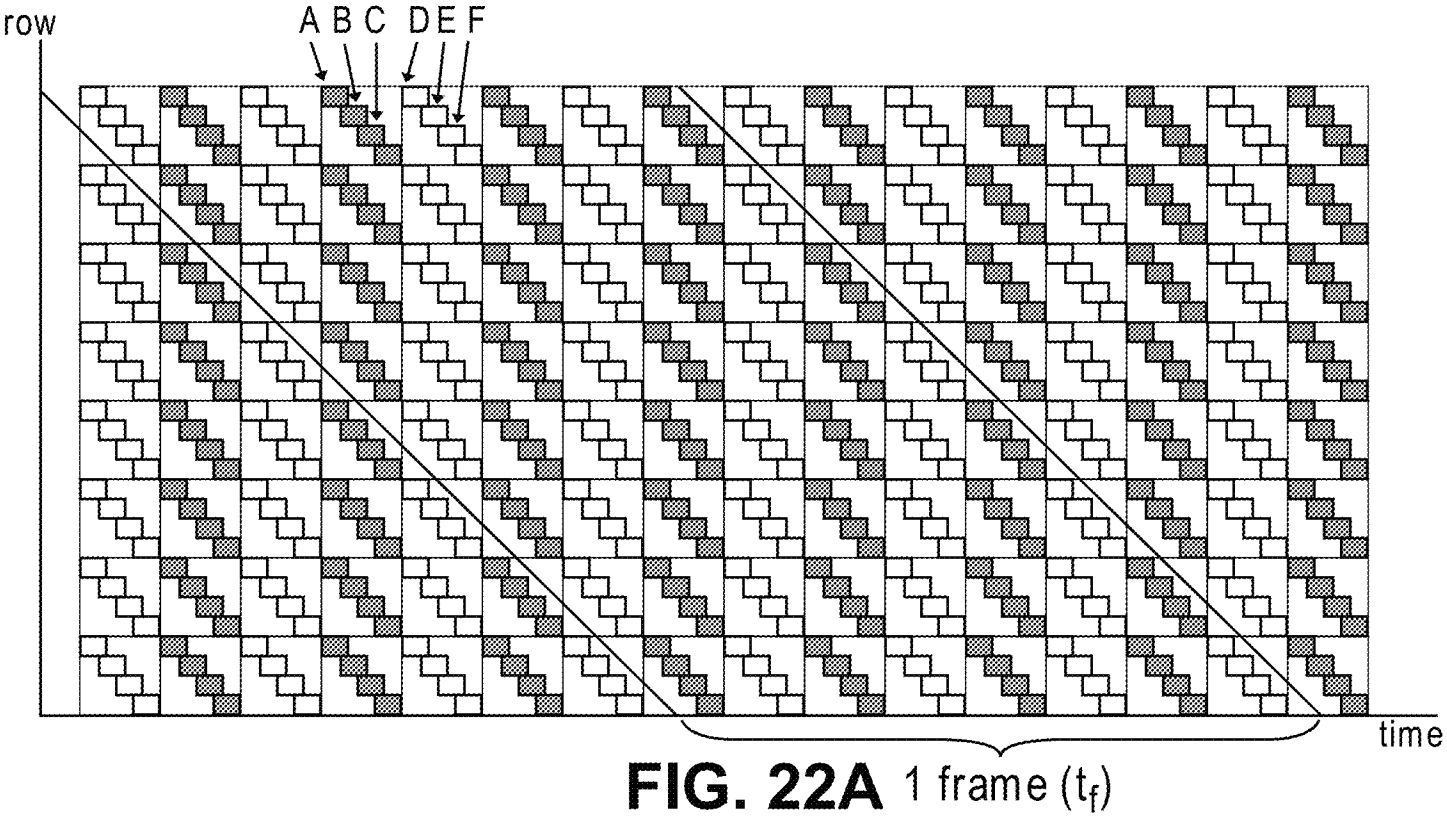
FIG. 22A is a time and row position diagram for an emission pattern according to one embodiment of the disclosure.

In certain embodiments, a rolling emission pattern may include (e.g., significant) empty space (e.g., more time not emitting than emitting), for example, when the emission pulse length is relatively short (e.g., less than 25% of the maximum pulse length). In certain embodiments, this empty space (e.g., no emissions) may cause motion artifacts. In one embodiment, the empty space in a position diagram may be reduced by increasing (e.g., doubling) the number of pulses within a row, as shown in FIG. 22A where an emission of four possible pulses per data frame is increased to eight possible pulses per data frame. In certain embodiments, emitting each display element (e.g., μLED) at twice the frequency may cause a pulse width of each pulse to be reduced by a factor of two to achieve the same amount of total light output which may put additional constraints on the LSB pulse size in the (e.g., digital) architecture. By adding an additional output selection (e.g., column selection) to the emission control, it may increase the apparent number of pulses without changing the frequency per display element (e.g., μLED). For example, the emission controller may use the column selection (e.g., and/or output selection in FIGS. 20-21) signal to alternate the emission of the odd and even columns. An example is illustrated in FIGS. 22A-22D described in further detail below.

Figure 22B:
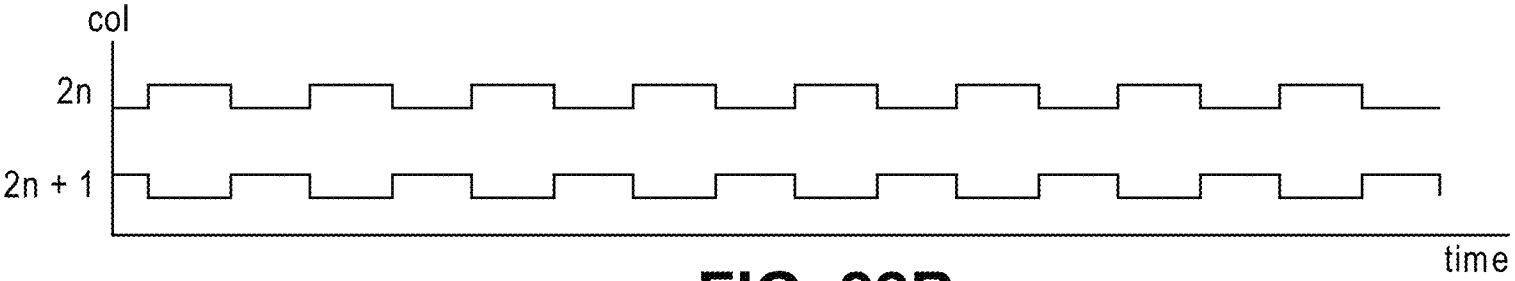
FIG. 22B is an embodiment of a time and column position diagram for the emission pattern in FIG. 22A.
Figure 22C:
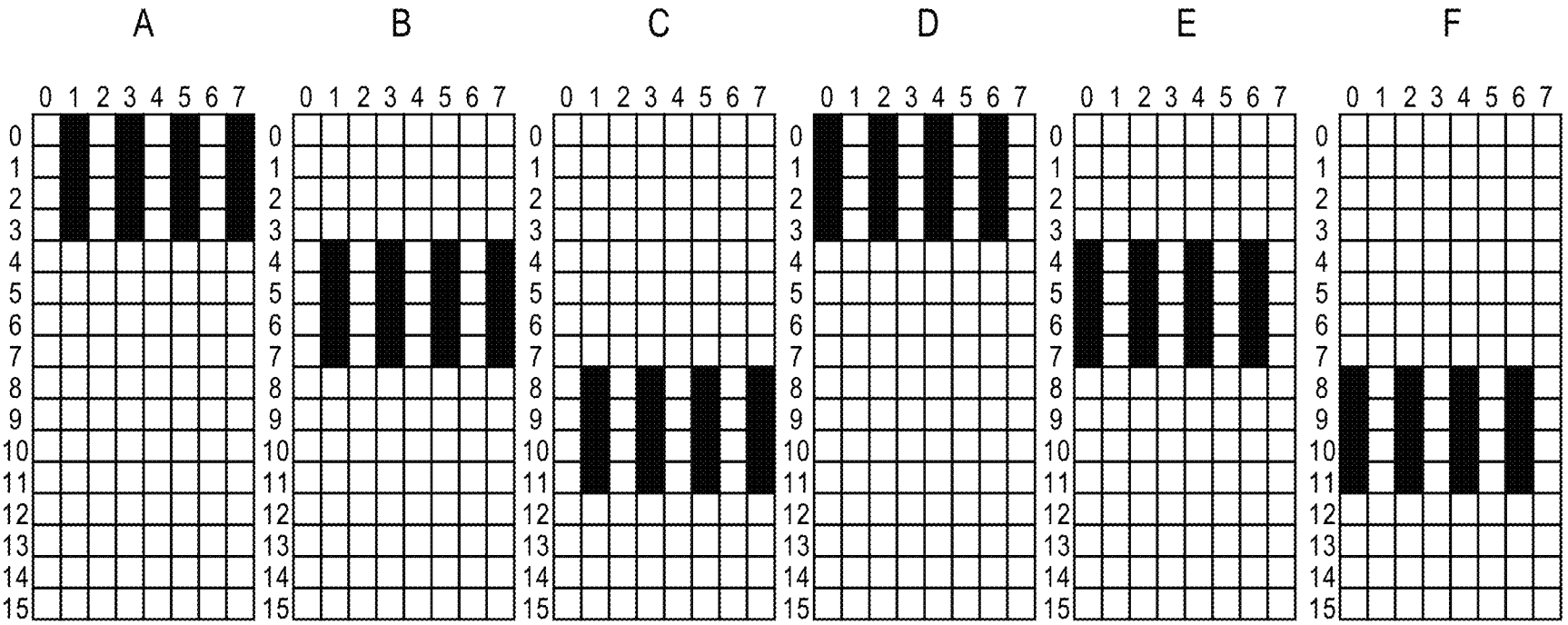
FIG. 22C is a diagram of an embodiment of the progression of emitting pixels (e.g., indicated by black) that corresponds to the timing diagrams in FIGS. 22A-22B.
Figure 22D:
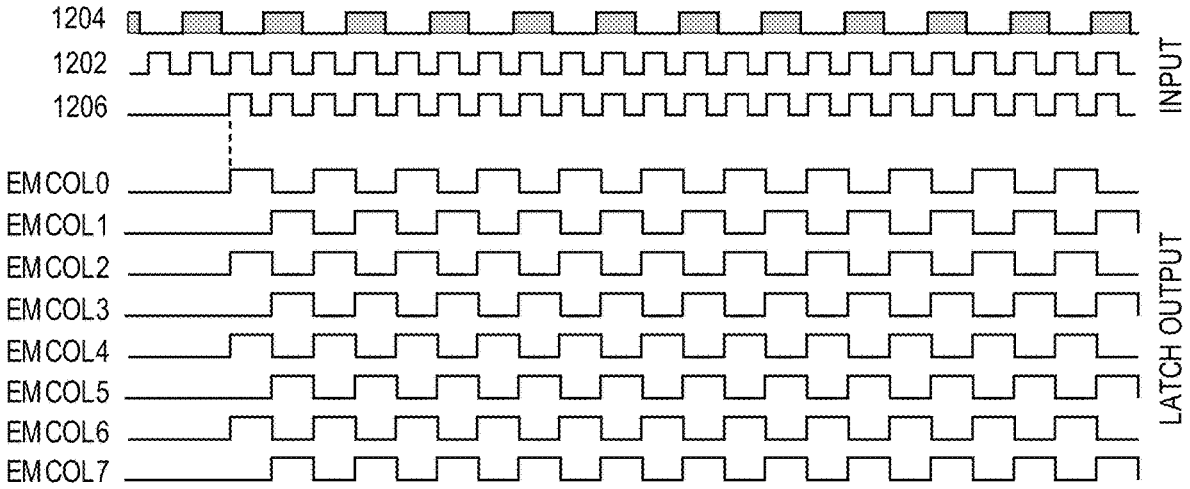
FIG. 22D is an embodiment of a timing diagram for the emission column select driver that corresponds to FIGS. 22A-22C.

FIG. 22A is a time and row position diagram for an emission pattern according to one embodiment of the disclosure. The white boxes may indicate even columns and the dark boxes may indicate odd columns. FIG. 22B is an embodiment of a time and column position diagram for the emission pattern in FIG. 22A. FIG. 22C is a diagram of an embodiment of the progression of emitting pixels (e.g., indicated by black) that corresponds to the timing diagrams in FIGS. 22A-22B. Using an example group of pixels, this diagram shows the progression of the emitting pixels (indicated by black here) that correspond to the timing diagrams in FIGS. 22A-22B with the moments in time (A, B, C, D, E, F) also indicated in FIG. 22A. FIG. 22D is an embodiment of a timing diagram for the emission column select driver that corresponds to FIGS. 22A-22C where alternating odd and even column are being selected. The example above utilizes column selection that differentiates between odd and even columns, however an emission controller may extend this to higher multiplication factors.

The time-position diagram in FIGS. 22A-22B may be a grid of squares. Within each square there may be a (e.g., small) rolling emission pattern. By increasing the density of the square grid, an emission controller may achieve a higher multiplication factor. An example of a grid is shown in FIG. 23B. Additionally, the row versus time selection within each square may be that in FIG. 23C. This column selection may be achieved by clocking in a lower frequency start pulse (e.g., shift register input 1204), for example, as compared to the diagram in FIG. 22D.

FIG. 23A is schematic timing diagram 2300 of an emission pattern according to one embodiment of the disclosure where each row starts emitting at different times. A group of columns may begin emitting at different times, e.g., every $2^{nd}$, $3^{rd}$, $4^{th}$ (e.g., as depicted in FIG. 23A) $5^{th}$, $6^{th}$, $7^{th}$, $8^{th}$, $9^{th}$, $10^{th}$, $15^{th}$, $20^{th}$, etc., column may begin emitting at the same time. FIG. 23B is a time and row position diagram for an emission pattern according to one embodiment of the disclosure with four different column start times per data frame. FIG. 23C is an embodiment of a time and row position diagram for a square of the grid in FIG. 23B. Emission controller may assert output select signal to cause (e.g., adjacent) display elements to begin emitting light at different times.

Figure 24:
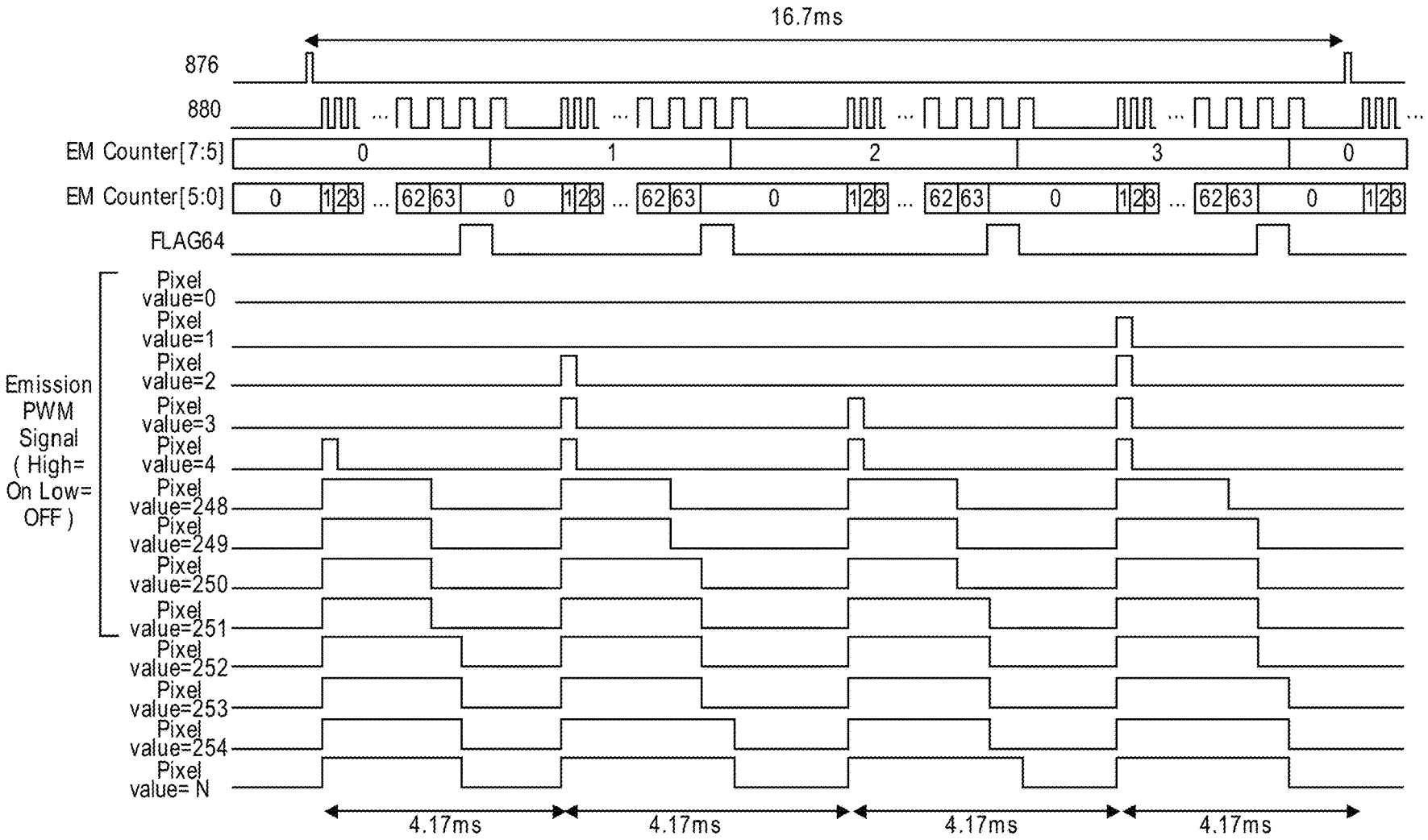
FIG. 24 is a timing diagram for emission control according to one embodiment of the disclosure.
Figure 25:
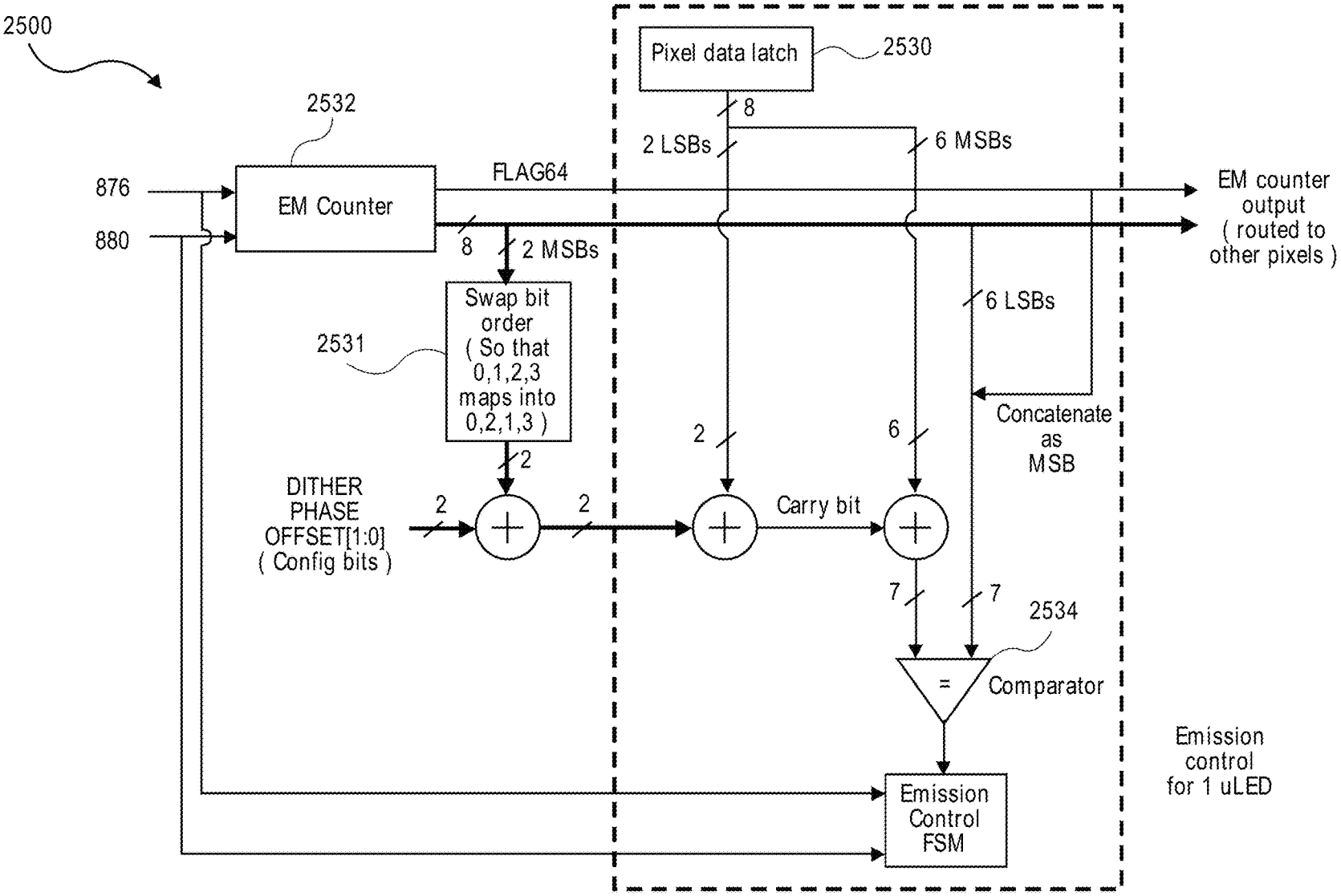
FIG. 25 is a block diagram for emission control according to one embodiment of the disclosure.

FIG. 24 is a timing diagram for emission control according to one embodiment of the disclosure, e.g., when operating in Mode 1. FIG. 25 is a block diagram for emission control (Mode 1) according to one embodiment of the disclosure. FIG. 26 is a pulse diagram for emission control (Mode 1) according to one embodiment of the disclosure. In one embodiment, instead of dividing the total pulse length (e.g., for a pulse less than its maximum length) for a data frame equally between multiple pulses, an emission controller may instead only increment the length (e.g., in time) of one pulse of the multiple pulse sequence for each successive increase in gray level. For example, in reference to FIGS. 24 and 26, an emission controller may only increase the length (e.g., in time) of one pulse (e.g., not the immediately previous pulse increased) of multiple pulses that display a single data frame for each successive increase in gray level. Thus, gray level may be modulated by increasing a pulse length of less than all of the multiple pulses in a data frame. In one embodiment, the emission controller (e.g., via a FSM) may increment the length (e.g., in time) of the next (or previous) pulse of a multiple pulse sequence that displays a single data frame for each successive increase in gray level (e.g., such that the increases repeatedly cycle through the pulses). In one embodiment, the emission controller (e.g., via a FSM) may increment the length (e.g., in time) of non-adjacent pulses for each successive increase in gray level (e.g., such that the increases cycle through the pulses). The other previous (e.g., non-zero) pulse lengths may retain their value for the successive increases in gray level, for example, until being reset.

For example, in reference to FIG. 24, there are four possible pulses for each data frame. At a gray scale (e.g., pulse length) value of 1, the length of the fourth pulse is changed from zero to a non-zero value. At a gray scale (e.g., pulse length) value of 2, the length of the second pulse is changed from zero to a non-zero value and the length of the fourth pulse is left at the previous non-zero value. At a gray scale (e.g., pulse length) value of 3, the length of the third pulse is changed from zero to a non-zero value and the lengths of the second pulse and the fourth pulse are left at the previous non-zero value. At a gray scale (e.g., pulse length) value of 4, the length of the first pulse is changed from zero to a non-zero value and the lengths of the second pulse, third pulse, and the fourth pulse are left at the previous non-zero value. This pattern may repeat, e.g., until the maximum gray scale level is achieved. The embodiment in FIG. 26 is similar to that in FIG. 24, however pulse 1 is the only pulse changed (e.g., increased) at an increment from sum zero to sum 0.016 (e.g., example numbers), pulse 3 is the only pulse changed at the next successive gray scale increase, pulse 2 is the only pulse changed after that successive gray scale increase, pulse 4 is the only pulse changed after that successive gray scale increase, etc.

FIG. 25 is a block diagram 2500 for emission control according to one embodiment of the disclosure. Emission control may be part of a unit cell and/or emission controller. Depicted circuit (e.g., unit cell and/or microdriver) includes a (e.g., hardware) counter 2532 with a gray scale clock input (e.g., as emission clock 880 signal) for each display element (e.g., a group of display elements) to count the incoming emission clock edges to generate the pulse-width modulation (PWM) signal to control the luminance of each display element (e.g., μLED). Depicted circuit also includes a reset input (e.g., as emission counter reset 876 signal) on the counter 2532, e.g., to reset the counter to zero. Gray scale clock counter value may be routed to other display elements (e.g., pixels). The data signal (e.g., for the data to be displayed) may be stored in a register (e.g., pixel data latch 2530) and compared with a comparator 2534 against the number of pulses stored in the emission counter 2532 to cause an output of light until the comparator indicated the emission has reached the value indicated by the data signal. There may be different modes of operation, e.g., a circuit capable of operating in either of two modes. Mode 1 may include the emission counter counting from an initial value (e.g., 0) to a maximum counter value (e.g., 64) to generate a (e.g., 6-bit, less than the bit pattern in Mode 0) PWM pattern in each (e.g., 4.17 ms) period and greater (e.g., 8-bit) precision than the counter is achieved by the temporal averaging in the human visual system. In Mode 1, the EM counter may be reset (e.g., by emission counter reset 876) and incremented on each emission clock 880 edge, e.g., similar to Mode 0. But the counter may count to a lower maximum value than in Mode 0 (e.g., from 0 to 64), generating fewer bits (e.g., only 6-bit) luminance in each (e.g., 4.17 ms) period. The emission may be turned on and off based on the comparison with this (e.g., 6-bit) emission counter and the data (e.g., pixel) value, but this data (e.g., pixel) value may be the (e.g., 6) most significant bits (MSBs) of a larger (e.g., 8-bit pixel) value plus 1 or 0, for example, based on the 2 MSBs of the emission counter 832 and the 2 LSBs of the 8-bit pixel value. The end result in this embodiment is a temporal dithering of 6-bit luminance to present an apparent 8-bit luminance control. Dither phase offset may be a (e.g., 2-bit) control that can adjust the phase of this temporal dithering (e.g., per display element or group of display elements). In one embodiment, this temporal dithering may avoid having every pixel emitting with the same timing causing a whole-screen flicker.

Figure 27:
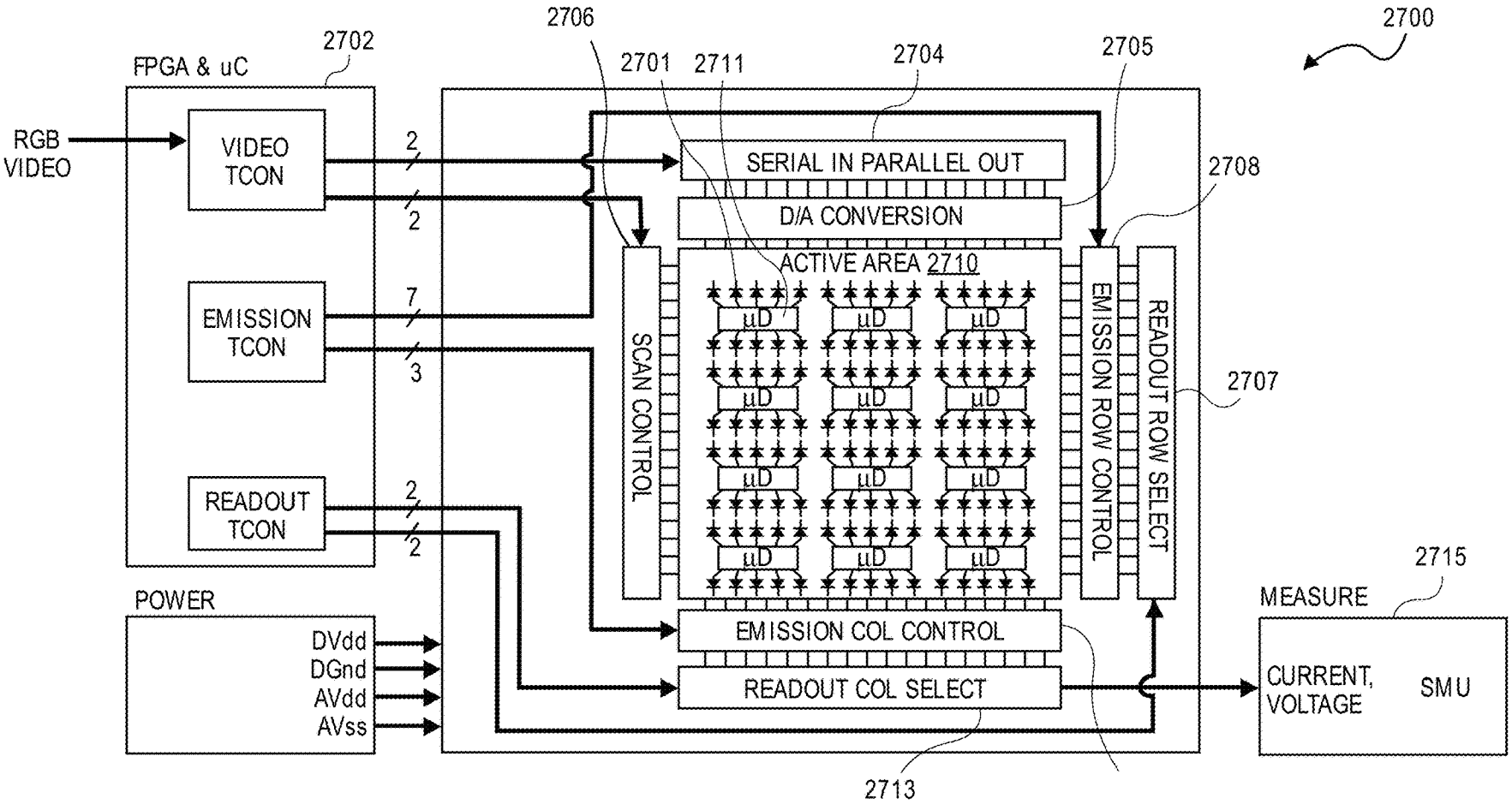
FIG. 27 is a display system including microdrivers that may include an analog pixel circuit or unit cell according to one embodiment of the disclosure.
Figure 28:
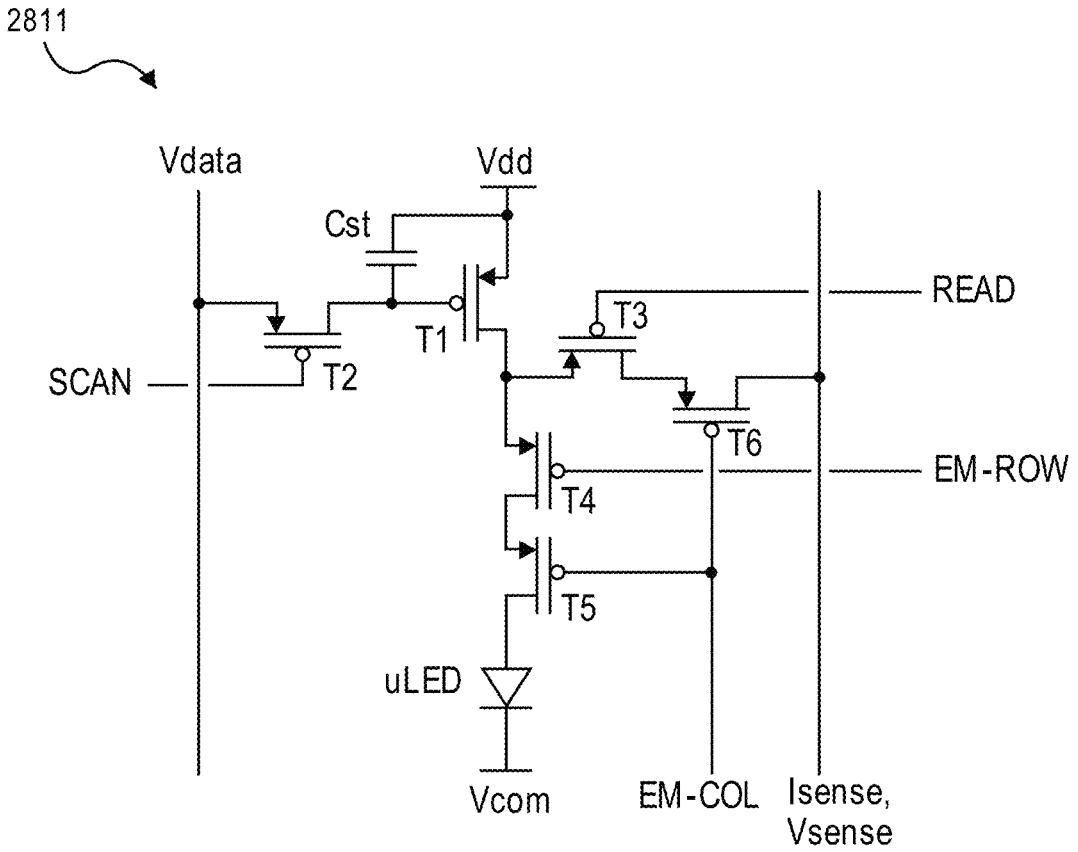
FIG. 28 is an analog pixel circuit or unit cell of a microdriver according to one embodiment of the disclosure.
Figure 29:
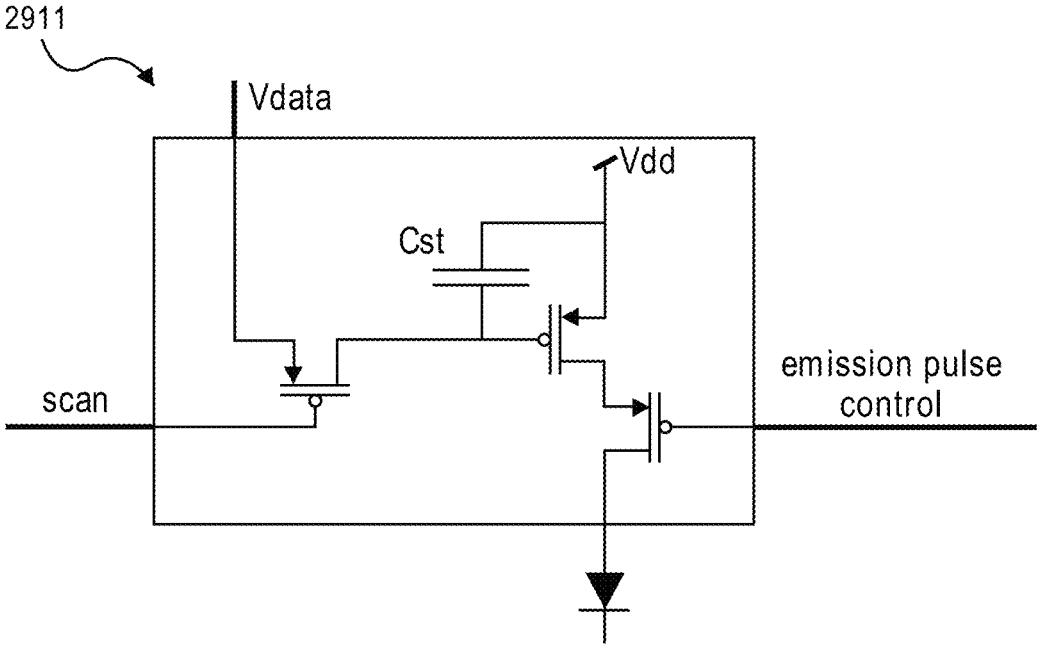
FIG. 29 is an analog pixel circuit or unit cell of a microdriver according to one embodiment of the disclosure.

Up until this point, the display architectures, including unit cells, have been described as digital. However, all embodiments are not limited to digital circuits, and analog circuits may be used in some embodiments. FIG. 27 is a display system 2700 that may implement an analog pixel circuit, or unit cell according to one embodiment of the disclosure. Exemplary unit cells 2811 and 2911 are illustrated in FIGS. 28 and 29, respectively. Active area 2710 may include one or more display elements (e.g., LED 2701) which may connect to one or more microdrivers (e.g., μD 2711) that drive the emission of light from the one or more display elements. Although the depicted microdrivers include ten display elements, the disclosure is not so limited and a microdriver may drive one display element or any plurality of display elements. Display element (e.g., 2701) may be a pixel, for example, with each pixel including three display element subpixels (e.g., a red, green, and blue LED). Serial In Parallel Out module 2704 may take (e.g., a stream) of serial digital video data and output it as parallel video data to the Digital to Analog converter 2705 (DAC) which may convert it to analog voltage level(s), e.g., for each column. Scan control module 2706 may select a SCAN row signal (e.g., one at the time) to sample the analog voltage produced by the DAC 2705. Emission control (e.g., emission row control 2708 and emission column control 2709) may select which display elements (e.g., sub-pixels) are emitting light at a given moment in time. Readout control (e.g., readout row select 2707 and readout column select 2713) may select which display element (e.g., single sub-pixel) is connected to the external readout pin, e.g., to measure the voltage and/or current thereof. In one embodiment, readout row select 2707 is based on a basic shift register in which only one row is active at a given time. For example, the READ switch may be closed for all display elements (e.g., pixels) in the selected row to create a connection between the display element (e.g., pixel) and the sense signal column. The sense column may carry the signal to the readout column select 2713 (e.g., a MUX with a shift register which selects only one sense column at a given time). The selected sense column may be routed to an output pin, depicted in FIG. 27 as being connected to a measurement unit 2715, e.g., a source measurement unit (SMU). An analog output may be current and/or voltage.

The analog pixel circuits, or unit cells 2811 and 2911 are merely examples, and other (e.g., analog) pixel circuits may be utilized. Referring to FIG. 28, the 6 transistor (6T) and 1 storage capacitor (1C) may include Cst: storage capacitor for holding the data voltage, T1: current driving transistor, T2: switch for sample and hold, T3: switch for sense column line connection, T4: switch (row) for turning the emission on and off, T5: switch (column) for turning the emission on and off, and T6: switch (column) for selecting sense column. In one embodiment, T6 may be part of the readout column select 2713. In one embodiment, the digital signals are SCAN: generated by row driver (e.g., to sample Vdata), READ: generated by row driver (e.g., to connect a pixel circuit to sense column line), EM-ROW: generated by row driver (e.g., to emit light if EM-COL is also active), and EM-COL: generated by column driver (e.g., to emit light if EM-ROW is also active). In one embodiment, the analog signals are Vdata (input): analog data to be sampled and which sets the gate voltage of the current driving transistor T1, Isense (output): when the read-out switch T3 and switches T5 and T6 are closed and the emission switch T4 is open, the current from T1 may be flowing through the sense column line and may be measured outside the chip, and Vsense (output): when the read-out switch T3 and switches T5 and T6 are closed and both emission switches are closed, the current from T1 may flow through the display element (e.g., μLED) and the voltage level on the display element (e.g., μLED anode, minus voltage drop of T4 and T5) may be measured from the sense column line.

In one embodiment, a display driver hardware circuit (e.g., a hardware emission controller 2702 and/or other components) may include one or more of: row selection logic (e.g., 2707 and/or 2708) to select a number of rows in an emission group of a display panel, wherein the number of rows is adjustable from a single row to a full panel of the display panel, column selection logic (e.g., 2709 and/or 2713) to select a number of columns in the emission group of the display panel, wherein the number of columns is adjustable from a single column to the full panel of the display panel, and emission logic (e.g., 2702) to select a number of pulses per data frame to be displayed, wherein the number of pulses per data frame is adjustable from one to a plurality and a pulse length is adjustable from a continuous duty cycle to a non-continuous duty cycle.

Referring briefly back to FIG. 3A, the unit cells illustrated and described with regard to FIGS. 28-29 may be used for amplitude modulation (AM) of the display elements (e.g., pixels), in which modulation of the pulse current level per pixel sets the grey level. Now referring briefly back to FIG. 3B, the unit cell illustrated and described with regard to FIG. 8 may be used for pulse width modulation (PWM) of the display elements (e.g., pixels), in which modulation of the pulse width per pixel sets the grey level. Referring now to FIG. 3C, in some embodiments a hybrid unit cell may be used for hybrid modulation in which pulse width control per pixel sets the coarse grey level, and current level per pixel sets the fine grey level.

Figure 30:
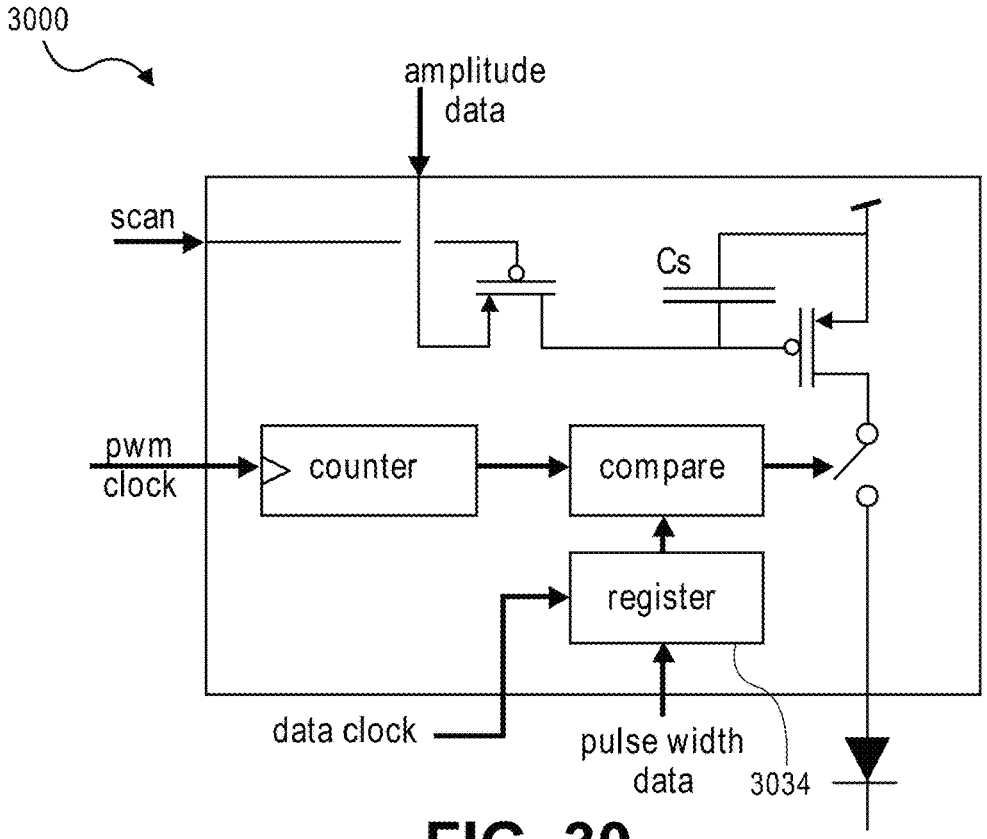
FIG. 30 is a hybrid digital and analog unit cell of a microdriver according to one embodiment of the disclosure.

FIG. 30 is a hybrid digital and analog unit cell 3000 of a microdriver according to one embodiment of the disclosure. The unit cell 3000 in FIG. 30 includes an analog current source controlled by an analog memory cell (e.g., the storage capacitor Cs). In this embodiment, the pulse width selection may be controlled by a digital memory cell (e.g. register 3034), for example, similar to as in FIG. 8. The current level from a (e.g., analog) current source may be controlled to be a variable (e.g., in use in a display system) current source. Other combinations are possible, for example, both the current level and pulse width may be controlled by digital memory, e.g., including a DAC to convert the digital value to a current level.

Figure 31:
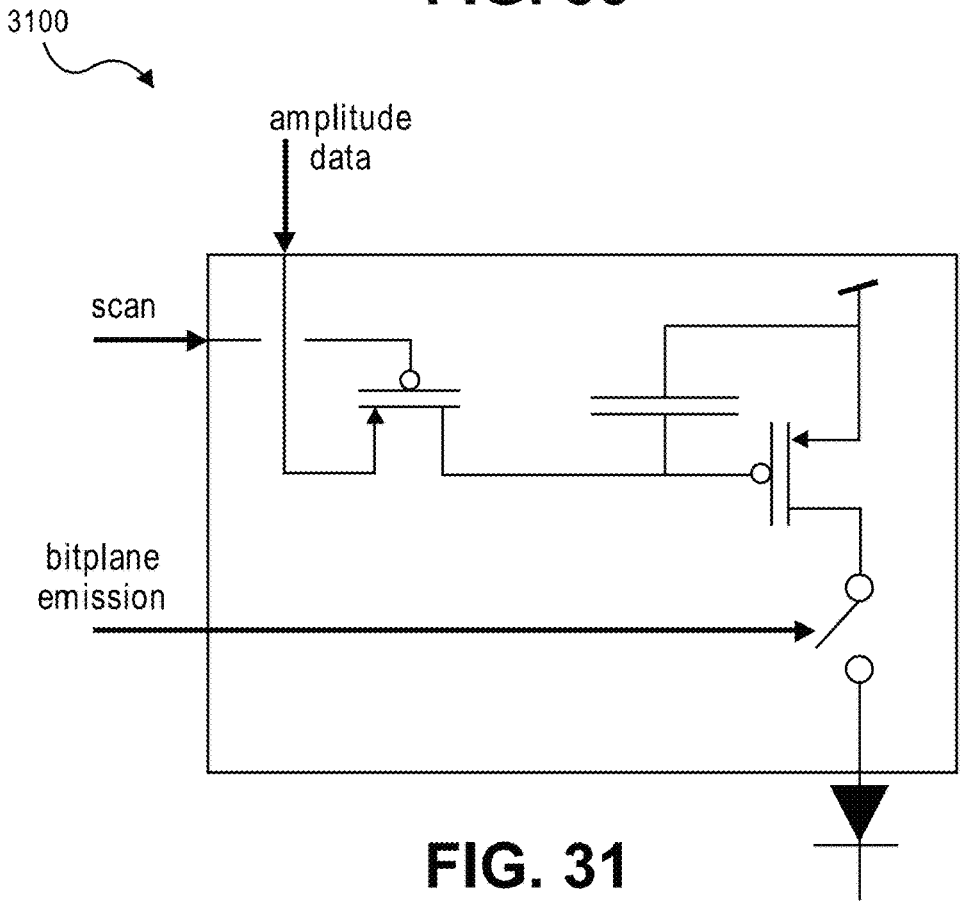
FIG. 31 is a hybrid digital and analog unit cell of a microdriver according to one embodiment of the disclosure.

There are also other type of hybrid addressing scheme architectures that may not utilize and require memory within the unit cell, e.g., they may utilize data loading events. FIG. 31 is a hybrid digital and analog unit cell 3100 of a microdriver according to one embodiment of the disclosure with a bitplane style of driving, however the intensity of the light emission may not be limited to being only on or off and may be modulation within a bitplane by adjusting the current level. In one embodiment, there are multiple (e.g. 3) pulse widths. Data may be written to the pixel to tell what intensity the display element (e.g., LED) should have during that emission time. Once the data is loaded for all the rows, a global emission may be started by turning on the bitplane emission signal within the unit cells. After that emission pulse, new data may be loaded for the next emission pulse width. This is merely one scheme for an emission controller, one non-limited example is that instead of waiting to start emission after all rows have been loaded with new data, one can start the emission in segments. This may be more time efficient (e.g., less dead time) and use less global peak current because a rolling emission pattern is used.

Figure 32:
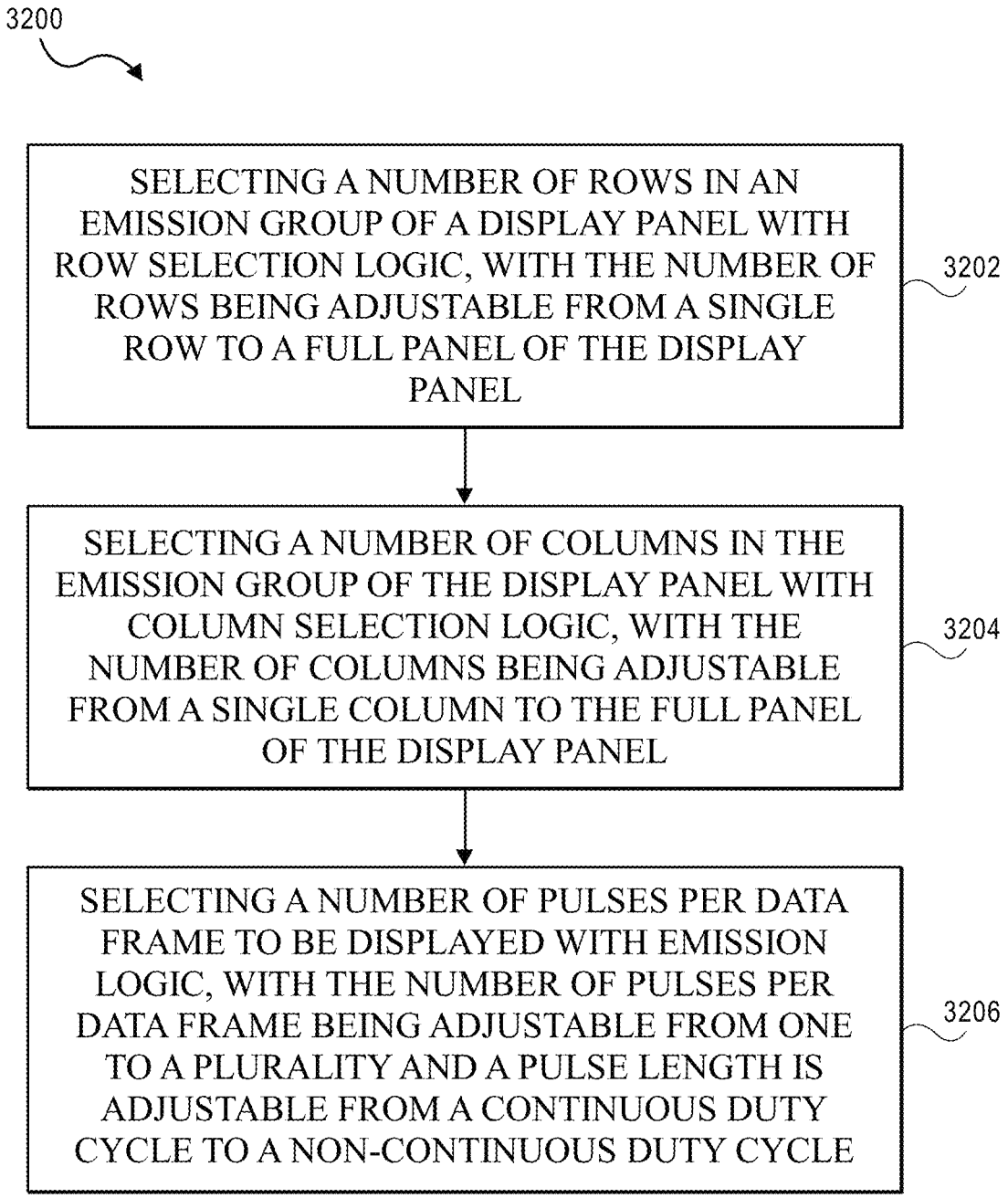
FIG. 32 is a flow diagram according to one embodiment of the disclosure.

FIG. 32 is a flow diagram 3200 according to one embodiment. Depicted flow diagram 3200 includes selecting a number of rows in an emission group of a display panel with row selection logic, with the number of rows being adjustable from a single row to a full panel of the display panel 3202, selecting a number of columns in the emission group of the display panel with column selection logic, with the number of columns being adjustable from a single column to the full panel of the display panel 3204, and selecting a number of pulses per data frame to be displayed with emission logic, with the number of pulses per data frame being adjustable from one to a plurality and a pulse length is adjustable from a continuous duty cycle to a non-continuous duty cycle 32066. In other embodiments, a flow diagram may include any of the disclosure herein.

The term "on" used in connection with a device may generally refer to an activated state of the device, and the term "off" used in this connection may refers to a deactivated state of the device. The term "on" used in connection with a signal received by a device may generally refer to a signal that activates the device, and the term "off" used in this connection may generally refer to a signal that deactivates the device. A device may be activated by a high voltage or a low voltage, depending on the underlying principles implementing the device.

A display system may include a receiver to receive display data from outside of the display system. The receiver may be configured to receive data wirelessly, by a wire connection, by an optical interconnect, or any other connection. The receiver may receive display data from a processor via an interface controller. In one embodiment, the processor may be a graphics processing unit (GPU), a general-purpose processor having a GPU located therein, and/or a general-purpose processor with graphics processing capabilities. The display data may be generated in real time by a processor executing one or more instructions in a software program, or retrieved from a system memory. A display system may have any refresh rate, e.g., 50 Hz, 60 Hz, 100 Hz, 120 Hz, 200 Hz, or 240 Hz.

Depending on its applications, a display system may include other components. These other components include, but are not limited to, memory, a touch-screen controller, and a battery. In various implementations, the display system may be a television, tablet, phone, laptop, computer monitor, automotive heads-up display, automotive navigation display, kiosk, digital camera, handheld game console, media display, ebook display, or large area signage display.

In utilizing the various embodiments of this disclosure, it would become apparent to one skilled in the art that combinations or variations of the above embodiments are possible for controlling emission of a display panel. Although the present disclosure has been described in language specific to structural features and/or methodological acts, it is to be understood that the disclosure defined in the appended claims is not necessarily limited to the specific features or acts described. The specific features and acts disclosed are instead to be understood as particularly graceful implementations of the claimed disclosure useful for illustrating the present disclosure.

What is claimed is:

1. A method of operating a micro light emitting diode (LED) display comprising:

sending a first emission clock signal characterized by a first emission phase from a first pulse controller to a corresponding first row of first driver chips distributed across an active area of a display panel, wherein each first driver chip is coupled to a corresponding plurality of pixels of micro LEDs;

sending a second emission clock signal characterized by a second emission phase from a second pulse controller to a corresponding second row of second driver chips distributed across the active area of the display panel, wherein each second driver chip is coupled to a corresponding plurality of pixels of micro LEDs; and sending a third emission clock signal characterized by a third emission phase from a third pulse controller to a corresponding third row of third driver chips distributed across the active area of the display panel, wherein each third driver chip is coupled to a corresponding plurality of pixels of micro LEDs;

wherein the first emission phase, the second emission phase, and the third emission phase are staggered.

2. The method of claim 1, further comprising sending a first data signal to a first column of driver chips overlapping the first row of first driver chips, the second row of second driver chips, and the third row of third driver chips, and storing pixel data from the first data signal in the first column of driver chips.

3. The method of claim 2, further comprising storing an emission counter value of a number of pulses from the first emission clock signal in counters within the first driver chips in the first row of first driver chips.

4. The method of claim 3, further comprising comparing the emission counter value with the stored pixel data within a first driver chip in the first row of driver chips and the first column of driver chips, and emitting from the plurality of pixels of micro LEDs coupled to the first driver chip for a specified number of emission clock periods corresponding to the number of pulses within a data frame.

5. The method of claim 4, further comprising sending a first emission counter reset signal characterized by the first emission phase from the first pulse controller to the first row of first driver chips distributed across the active area of the display panel.

6. The method of claim 4, further comprising modulating a grey level of the emission by increasing a pulse length of less than all of the number of pulses in the data frame.

7. The method of claim 6, wherein the emission includes the number of pulses at a same amplitude.

8. The method of claim 6, further comprising modulating coarse grey level by increasing the pulse length of less than all of the number of pulses in the data frame, and modulating fine grey level with current level.

9. The method of claim 1, wherein each micro LED is characterized by a maximum lateral dimension of 1 to 300 μm.

10. The method of claim 1, further comprising:

sending a first group of emission clock signals characterized by the first emission phase from a first plurality of rows of pulse controllers to a corresponding first plurality of rows of first driver chips distributed across the active area of the display panel;

sending a second group of emission clock signal characterized by the second emission phase from a second plurality of rows of pulse controllers to a corresponding second plurality of rows of second driver chips distributed across the active area of the display panel; and sending a third group of emission clock signals characterized by the third emission phase from a third plurality of rows of pulse controllers to a corresponding third plurality of rows of third driver chips distributed across the active area of the display panel.

11. The method of claim 10, wherein the first group of emission clock signals includes a first signal bundle from each pulse controller of the first plurality of rows of pulse controllers comprising:

a first red emission clock signal for red emitting micro LEDs;

a first blue emission clock signal for blue emitting micro LEDs; and a first green emission clock signal for green emitting micro LEDs.

12. The method of claim 11, wherein the second group of emission clock signals includes a second signal bundle from each pulse controller of the second plurality of rows of pulse controllers comprising:

a second red emission clock signal for red emitting micro LEDs;

a second blue emission clock signal for blue emitting micro LEDs; and a second green emission clock signal for green emitting micro LEDs.

13. The method of claim 11, wherein the third group of emission clock signals includes a third signal bundle from each pulse controller of the third plurality of rows of pulse controllers comprising:

a third red emission clock signal for red emitting micro LEDs;

a third blue emission clock signal for blue emitting micro LEDs; and a third green emission clock signal for green emitting micro LEDs.

14. The method of claim 1, further comprising emitting from the plurality of pixels of micro LEDs coupled to the first row of first driver chips for a plurality of pulses within a data frame.

15. The method of claim 14, further comprising modulating a grey level of the emission by increasing a pulse length of less than all of the plurality of pulses in the data frame.

16. The method of claim 15, wherein the emission includes the plurality of pulses at a same amplitude.

17. The method of claim 15, further comprising modulating coarse grey level by increasing the pulse length of less than all of the plurality of pulses in the data frame, and modulating fine grey level with current level.

* * * * *